US012662808B2

(12) United States Patent
Cymbala

(10) Patent No.: US 12,662,808 B2
(45) Date of Patent: Jun. 23, 2026

(54) BRACKETS FOR INSULATED CONCRETE FORMS AND METHODS OF MANUFACTURING AND INSTALLATION THEREOF

(71) Applicant: P & W CONSTRUCTION MATERIALS AND CONSULTING LTD., Canmore (CA)

(72) Inventor: Pat Cymbala, Canmore (CA)

(73) Assignee: P & W Construction Materials and Consulting Ltd, Canmore (CA)

( * ) Notice: Subject to any disclaimer, the term of this patent is extended or adjusted under 35 U.S.C. 154(b) by 270 days.

(21) Appl. No.: 18/272,546

(22) PCT Filed: Jan. 17, 2022

(86) PCT No.: PCT/CA2022/050063
§ 371 (c)(1),
(2) Date: Jul. 14, 2023

(87) PCT Pub. No.: WO2022/150931
PCT Pub. Date: Jul. 21, 2022

(65) Prior Publication Data

US 2024/0076866 A1 Mar. 7, 2024

Related U.S. Application Data

(60) Provisional application No. 63/138,381, filed on Jan. 15, 2021.

(51) Int. Cl.
*E04B 1/38* (2006.01)
*B21D 53/36* (2006.01)

(52) U.S. Cl.
CPC ..... *E04B 1/388* (2023.08); *B21D 53/36* (2013.01); *E04B 2001/389* (2023.08)

(58) Field of Classification Search
CPC ..... E04B 1/388; E04B 2001/389
(Continued)

(56) References Cited

U.S. PATENT DOCUMENTS 1,141,210 A * 6/1915 Pirson ..... F16B 12/2009 160/381
2,176,450 A * 10/1939 Barnett ..... E04B 1/2612 52/704

(Continued)

OTHER PUBLICATIONS

Simpson Strong-Tie Company Inc., "ICF Connectors", F-C-ICFVLCAN19, 2019, 6 pages.

(Continued)

*Primary Examiner* — Paola Agudelo
(74) *Attorney, Agent, or Firm* — Troutman Pepper Locke LLP; Daniel G. Nguyen

(57) ABSTRACT

Existing systems require the installation of joists directly to a partially cast hanger or bracket or to the joist hanger. The present disclosure is related to the brackets for use in ICF systems allowing joist hangers to be directly mechanically attached to brackets obviating the need for the use of ledgers. A bracket includes a plate having one or more anchor members extending from the plate for casting into an ICF wall. A method of assembling a bracket includes cutting a sheet of metal to define the plate and the one or more anchor members and bending the anchor members toward from the plate. A method installing joist hangers includes inserting anchor members of brackets into an ICF wall pre-casting and attaching joist hangers to the brackets post-casting.

20 Claims, 24 Drawing Sheets

(58) Field of Classification Search
USPC ..... 52/65; 248/237
See application file for complete search history.

(56) References Cited

U.S. PATENT DOCUMENTS 4,120,600 A * 10/1978 Rees ..... F16B 12/46 403/231
4,198,175 A * 4/1980 Knepp ..... F16B 15/0046 52/289
4,353,664 A * 10/1982 Gilb ..... E04B 1/2612 52/702
5,228,261 A 7/1993 Watkins
5,890,337 A * 4/1999 Boeshart ..... E04B 2/8652 52/432
6,325,349 B1 * 12/2001 Breaux ..... A47H 1/14 248/262
6,446,409 B1 * 9/2002 Emerson ..... E04F 15/04 52/715
6,845,594 B2 1/2005 Harber
7,024,833 B1 4/2006 Rice
8,051,620 B2 * 11/2011 Kittlitz ..... E04B 1/2612 52/289
8,443,569 B2 * 5/2013 Sias ..... E04B 7/063 52/696
9,121,222 B2 * 9/2015 Walker ..... E06B 3/9687
2005/0155307 A1 * 7/2005 Timony ..... E04B 1/2612 52/506.01
2006/0059846 A1 * 3/2006 Rice ..... E04B 2/8647 52/702
2008/0202059 A1 8/2008 McCullough
2010/0064626 A1 * 3/2010 Kittlitz ..... E04B 1/2612 52/702
2017/0175381 A1 * 6/2017 Wesney ..... E04B 1/388
2022/0341154 A1 * 10/2022 Beach ..... E04B 1/2608

OTHER PUBLICATIONS

Search Strategy for International Application No. PCT/CA2022/050063 dated Jul. 21, 2022.
International Search Report and Written Opinion for PCT Application No. PCT/CA2022/050063 Dated Apr. 14, 2022.

* cited by examiner

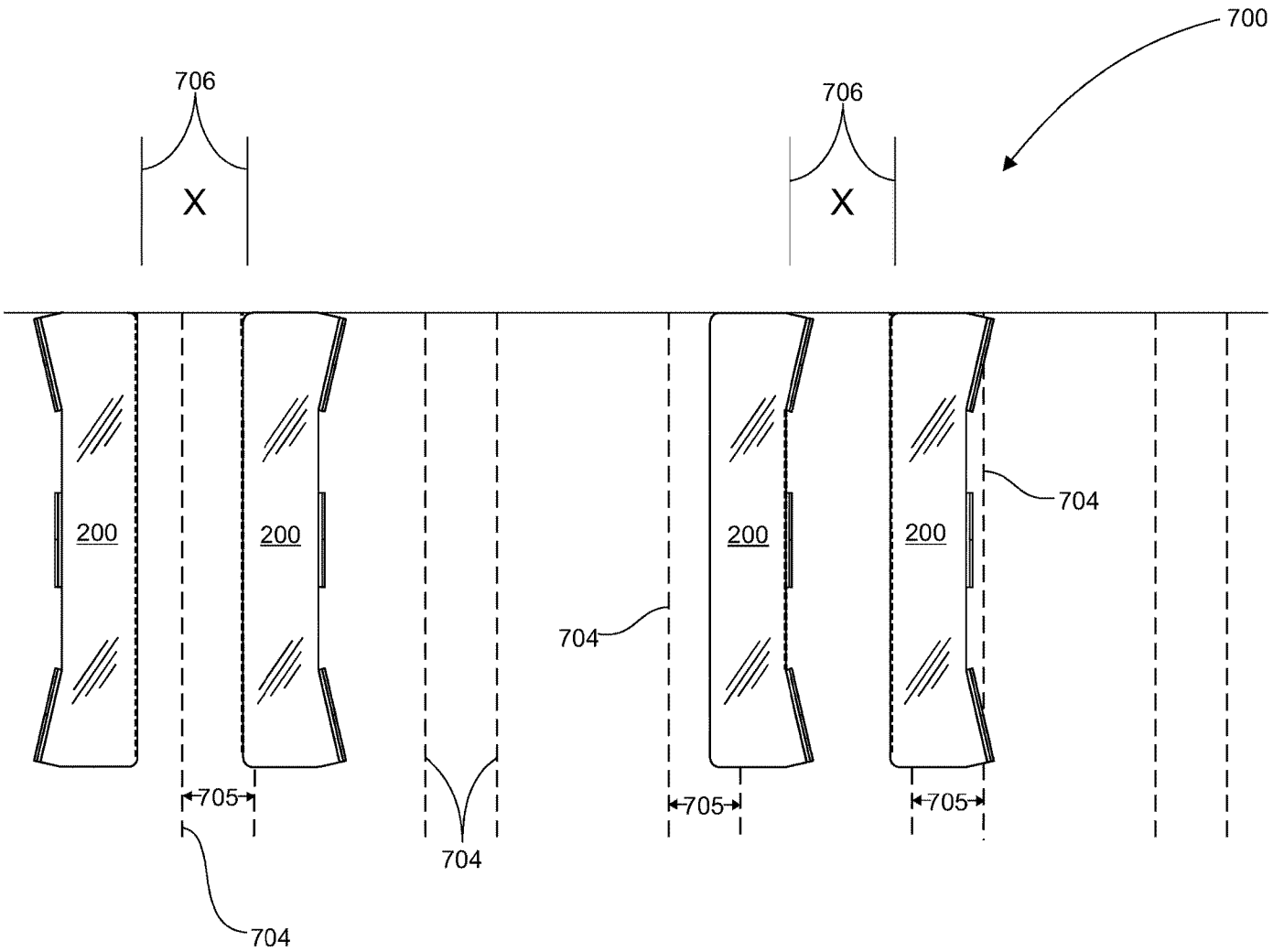
Fig. 7Fii

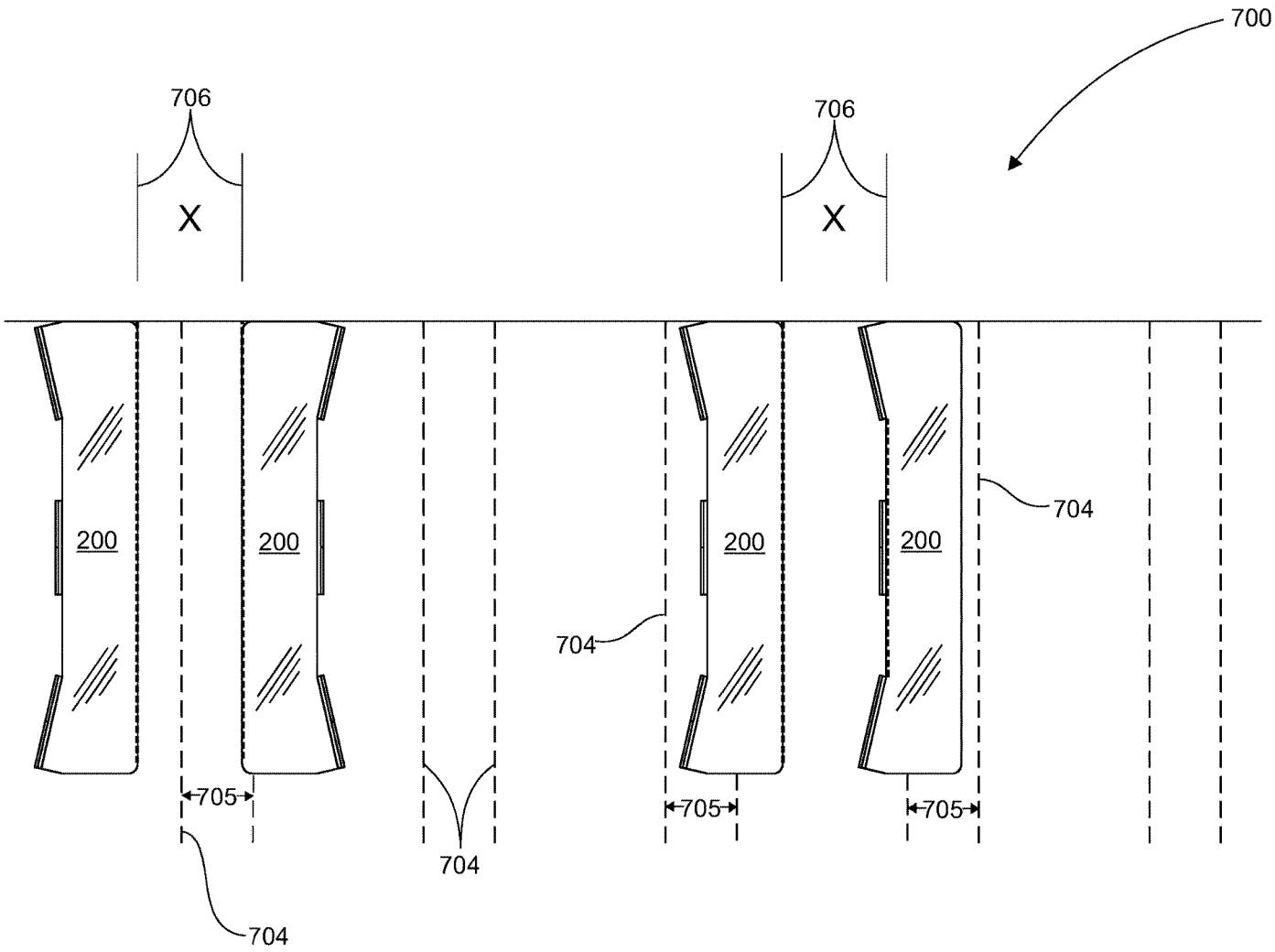
Fig. 7Fiii

BRACKETS FOR INSULATED CONCRETE FORMS AND METHODS OF MANUFACTURING AND INSTALLATION THEREOF

CROSS-REFERENCE TO RELATED APPLICATIONS

This application claims the benefit under 35 U.S.C 119(e) of U.S. Provisional application No. 63/138,381 filed on Jan. 15, 2021, incorporated herein by reference in its entirety.

FIELD

Embodiments of the disclosure relate to apparatus and methods relating to hardware for structural joints and beams, and specifically joint hanging hardware and methods relating to insulated concrete framework systems.

BACKGROUND

Both below-grade and above-grade concrete walls in building construction are commonly constructed using insulated concrete forms (or "ICF") systems. In conventional concrete wall-forming systems, a pair of panels is set up at a spacing corresponding to the desired thickness of the finished wall, thus creating a cavity between the panels. As necessary or desired, reinforcing bars are positioned within the formwork cavity. The form panels are secured in position using form ties extending between the form panels, and/or by means of external temporary bracing.

Fluid concrete is then introduced into the formwork cavity. After the concrete has cured sufficiently, the formwork panels are removed from the concrete wall. It is generally desirable to in insulate both above grade and below-grade building walls, in order to minimize through-wall heat transfer both from inside the building to the outside and from the outside into the building. By minimizing heat transfer, wall insulation reduces heating costs in cold weather, and reduces air conditioning costs in warm weather or enhances the comfort of persons in buildings that do not have air conditioning. For concrete walls constructed using conventional methods, insulation is typically applied to one or both wall surfaces, such as in the form of plastic foam insulation panels glued or otherwise attached to the concrete surface, or the form of fiberglass batts incorporated into stud walls or strapping systems installed adjacent to the wall surface. These conventional wall insulation methods and systems add to the total time and cost of building construction.

ICF systems combine plastic foam insulation panels and spacing means (such as plastic tie members) to create assemblies in which the insulation panels take the place of conventional wall form panels (e.g., plywood forms), and remain in place as permanent insulation after the concrete wall has been cast and cured. ICF systems thus reduce or eliminate the need to strip forms from the finished wall, thereby reducing construction labour costs. As well, construction time and costs are further reduced because wall insulation does not have to be installed as a separate task subsequent to wall construction.

It is commonly necessary or desirable for floor or roof beams and joists to act as struts providing effective lateral bracing to the walls that support them. In some cases, such bracing action may be structurally required on a long term basis. In other cases, the beams and joists may need to provide bracing only until the complete floor or roof structure is in place. This bracing effectiveness is easily achieved in conventional concrete wall construction by embedding the supported ends of the beams into the walls. Joists are commonly typically set on top of the finished concrete wall after the concrete has been placed and mechanically fastened both vertically and laterally.

However, it is somewhat difficult to embed beams and joists in concrete walls formed using ICF systems. This would typically require cutting out sections of insulation to accommodate the beams and joists, and in some cases temporary shoring may be needed because the ICF panels may not be strong enough to support the weight of the embedded beams and joists during wall construction.

For these reasons, a variety of joist and beam hanger designs have been developed for use with ICF systems. U.S. Pat. No. 5,228,261 to Watkins ("Watkins") discloses a "U"-shaped joist hanger partially cast into concrete using reinforcing bars. U.S. Pat. No. 7,024,833 to Rice ("Rice") discloses a bracket partially cast into concrete and U.S. Pat. No. 8,051,620 to Kittlitz et al. ("Kittlitz") discloses a hanger partially cast into concrete. In Watkins, Rice and Kittlitz, the hanger or bracket is partially cast into the concrete wall for support. Joists are then attached to the portion of the hanger or bracket that is not embedded in the ICF wall.

Simpson Strong Tie Co., Inc.'s ICFVL ("ICFVL") Ledger Connector System comprises a bracket plate having a pair of perpendicular anchoring sections. With the ICFVL system, the anchoring sections are partially cast in the concrete wall for support. Once the concrete wall is cast, secondary members are attached to the anchoring sections. Joist hangers are then attached to which joists can then be installed.

The installation of joists directly to the partially cast hanger or bracket as in Watkins, Rice and Kittlitz or to the joist hanger with the ICFVL system is often challenging, which challenge is further increased because of ICF compression and expansion due to settling concrete. A need thus exists for an apparatus and method for improved and simplified installation of joists in ICF systems.

SUMMARY

This disclosure is related to the brackets for use in ICF systems allowing joist hangers to be directly mechanically attached to brackets obviating the need for the use of ledgers. Generally, the disclosure provides an apparatus that simplifies the installation of joist in ICF systems, each joist hanger being connected to a pair brackets. Each bracket has anchor members embedded in a cast concrete wall at varying angles to provide in-plane vertical and lateral resistance.

In a broad aspect, a bracket for attaching joist hangers to an ICF wall includes a face plate, a first anchor member and a second anchor member. The face plate has a top and a bottom edge, side edges, a front and a back surface, and a longitudinal centerline extending from the top edge to the bottom edge. The first anchor member and the second anchor member extend from a common side edge of the face plate substantially perpendicular to the front surface of the face plate. The first anchor member and the second anchor member are sized for insertion through an ICF panel of the ICF wall and into a formwork cavity of the ICF wall. The first anchor member and the second anchor member have a longitudinal axis extending from the face plate to a tip of the anchor member, and a transverse axis perpendicular thereto. The transverse axis of at least the first anchor member is offset by a first angle from the axis of the longitudinal centerline of the face plate. The transverse axis of the second anchor member is at a second angle relative to axis of the longitudinal centerline of the face plate.

In an embodiment, the first angle is between about 10 to about 60 degrees.

In an embodiment, the second angle is between about 0 to about 60 degrees.

In an embodiment, the first angle and the second angle are of the same magnitude.

In an embodiment, the first angle and the second angle mirror one another.

In an embodiment, the bracket also includes a central anchor member sized for insertion though the ICF panel and into the formwork cavity extending from the face plate, substantially perpendicular to the front surface of the face plate, from the common side edge between the first anchor member and the second anchor member.

In an embodiment, the central anchor member has a longitudinal axis extending from the face plate to a tip of the central anchor member, and a transverse axis perpendicular thereto, said transverse axis being parallel to the axis of the longitudinal centerline of the faceplate.

In an embodiment, the bracket also includes additional anchor members sized for insertion though the ICF panel and into the formwork cavity extending from the face plate substantially perpendicular to the front surface of the face plate and from the common side edge.

In an embodiment, each of the anchor members have an aperture.

In another broad aspect, a method of manufacturing a bracket for attaching joist hangers to an ICF wall includes providing a sheet of metal, cutting the sheet of metal to define a face plate having a longitudinal centerline extending from a top edge to a bottom edge of the face plate and a first and second anchor member extending from the face plate along a common side edge of the face plate, bending the first and the second anchor members along a fold line until the first and second anchor members extend substantially perpendicularly from a common surface of the face plate, wherein the fold line of at least the first anchor member is angularly offset from the longitudinal centerline of the face plate.

In an embodiment, the step of bending the first and second anchor members also includes bending the first and second anchor members along fold lines that are at mirroring angles to each other, relative to the longitudinal centerline of the face plate.

In an embodiment, the step of cutting the sheet of metal also includes cutting the sheet to define a central anchor member, and the method also includes the step of bending the central anchor member along a fold line until the central anchor member extends substantially perpendicularly from the common surface of the face plate.

In an embodiment, the step of bending the center anchor member also includes bending the center anchor member along a fold line that is parallel to the longitudinal centerline of the face plate.

In an embodiment, the step of cutting the sheet of metal also includes cutting the sheet to define one or more additional pairs of anchor members, and the method also includes the step of bending each anchor member of the additional pairs of anchor members along fold lines until the anchor members extend substantially perpendicularly from the common surface of the face plate.

In an embodiment, the method also includes the step of forming apertures in each of the anchor members.

In another broad aspect, a method of installing joist hangers on an ICF wall includes cutting slots in an ICF panel disposed around a formwork cavity, the slots sized for the insertion of anchor members of a pair of brackets therethrough, inserting the anchor members through the slots such that they extend into the formwork cavity, and such that face plates of the pair of brackets contact the ICF panel, pouring concrete into the formwork cavity of the ICF wall, and attaching a joist hanger to the face plates of the pair of brackets.

In an embodiment, the method also includes the step of marking the location of the slots in the ICF panel using the anchor members of the bracket.

In an embodiment, the method also includes the step of using reinforcing means to retain the brackets in place during the step of pouring concrete into the formwork cavity.

In an embodiment, the method also includes the steps of laying out ICF webs, laying out snap lines representing tops of joists, and laying out the locations of joists.

DETAILED DESCRIPTION

The present disclosure relates to embodiments of brackets used to attach joists in ICF systems and their methods of manufacturing and installation. Brackets for use with ICF and conventional concrete formed walls for attaching floor joist hangers to the concrete walls are described herein.

Figure 1:
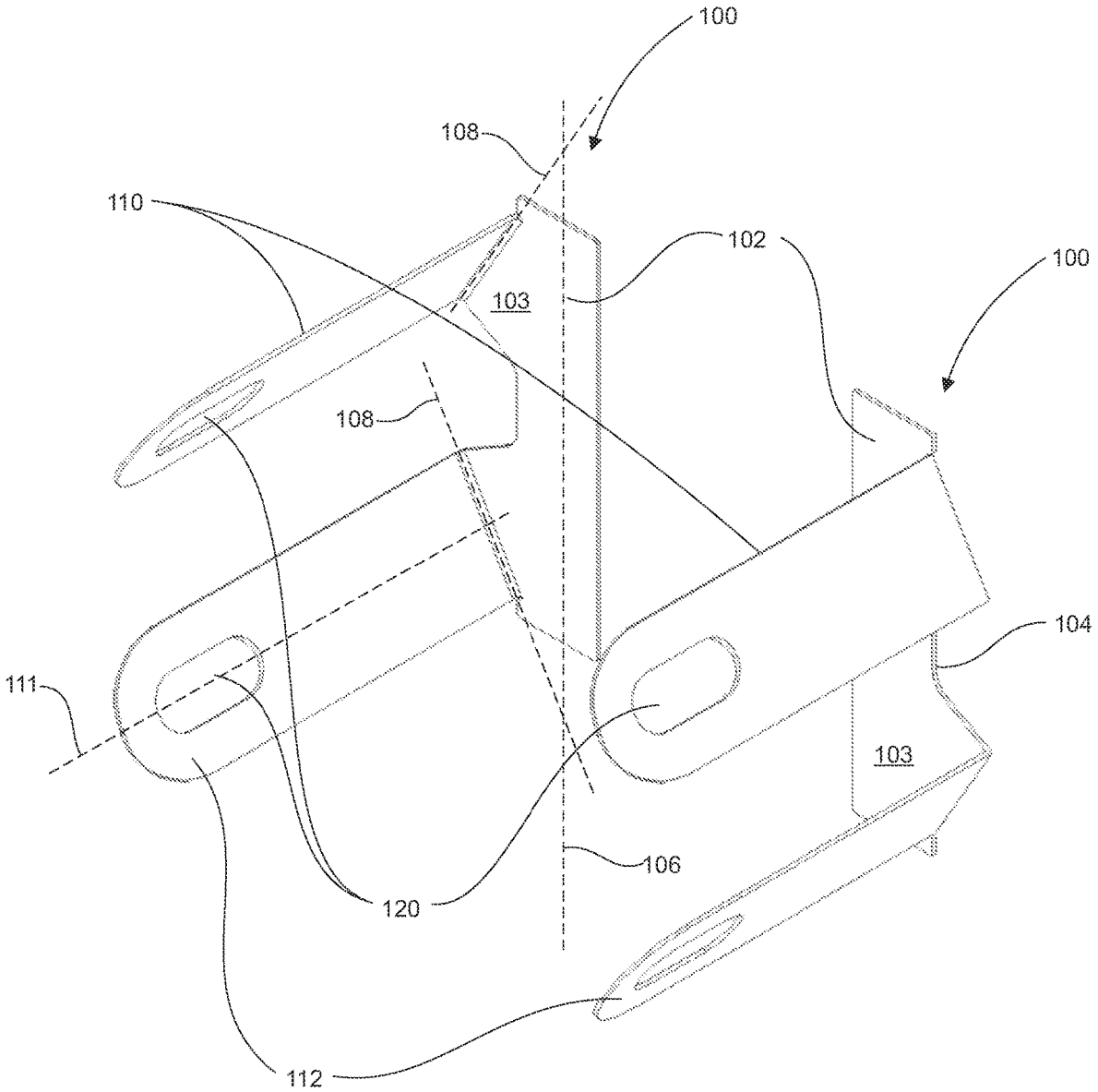
FIG. 1 is a perspective view of a pair of an embodiment of brackets, each bracket having two anchor members.

Referring to FIG. 1, a bracket 100 comprises a face plate 102 having a top and a bottom edge, side edges, a front surface 103 and a back surface, and a first anchor member 110 and a second anchor member 112 extending from the front surface 103 of the face plate 102. In other embodiments, a face plate comprises a single anchor member extending therefrom.

Each anchor member 110, 112 may extend substantially perpendicularly from the front surface 103 of the face plate 102, proximate a side edge or common side edge 104 (for two or more anchor members) of the face plate 102. Each anchor member has a longitudinal axis 111 extending from the face plate 102 to a tip (end), and a transverse axis 108 extending from side to side, perpendicular to the longitudinal axis 111. The transverse axis 108 of each anchor member 110, 112 may be angularly offset from the transverse axis 108 of one or more other anchor members 110, 112 and relative to a longitudinal axis or centerline 106 of the face plate 102, the longitudinal centerline 106 extending from the top edge and the bottom edge. In embodiments, each anchor member 110, 112 comprises one or more apertures 120, which provide further reinforcement of the anchor member 110, 112 when cast in concrete by having concrete being cast therethrough.

The angular offset of the anchor members 110, 112 relative to the longitudinal centerline 106 of the face plate 102 and relative to each other provides increased vertical and lateral anchoring of the bracket 100 once cast in concrete.

Figure 2:
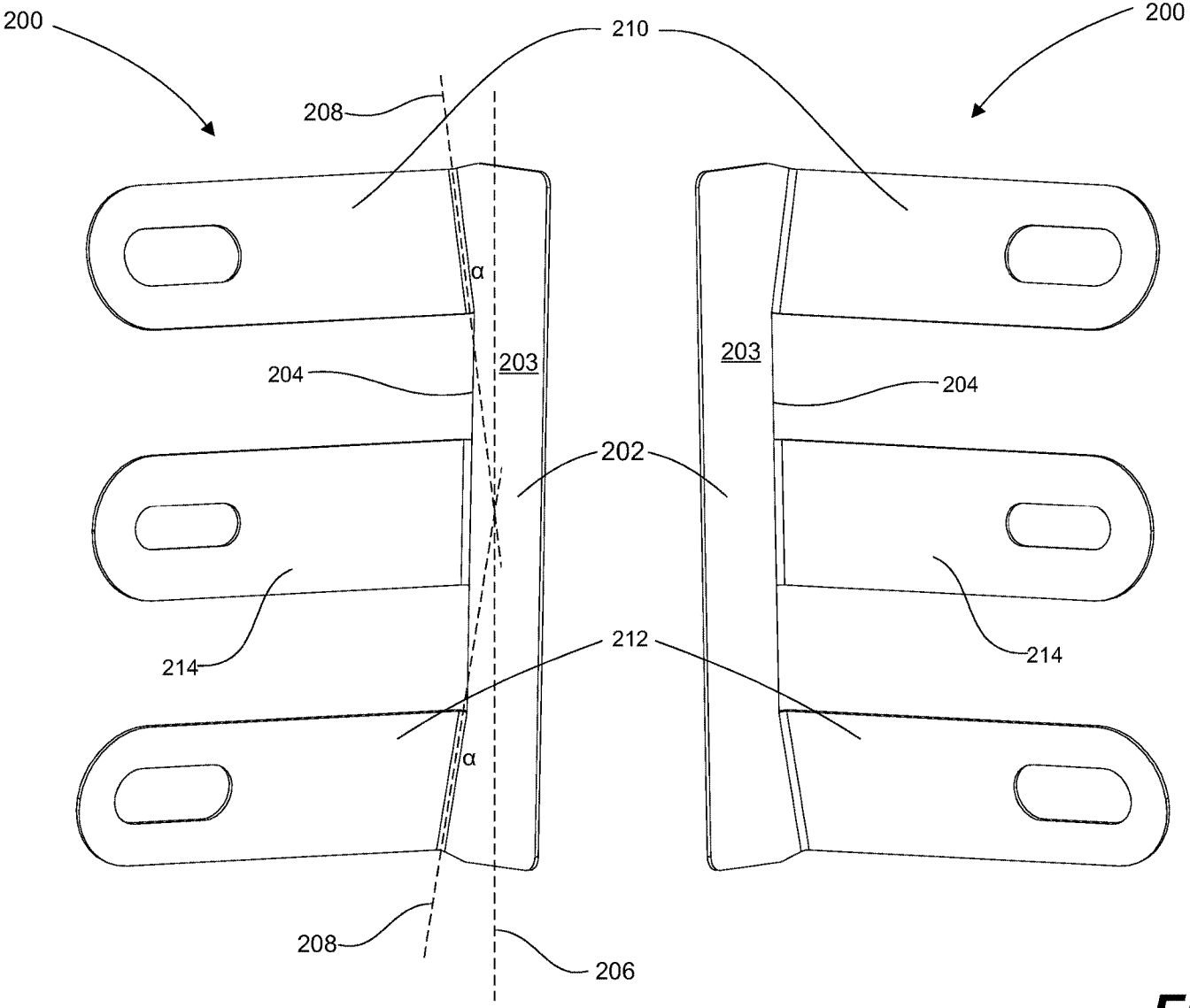
FIG. 2 is a perspective view of a pair of an embodiment of brackets, each bracket having three anchor members.

In embodiments, a bracket comprises three anchor members angularly offset from one another with respect to their transverse axes. Increasing the number of anchor members at differing angular offsets provides direct vertical and lateral support in an increased number of directions, which generally increases the load capacity of the bracket. Referring to FIG. 2, in embodiments, a bracket 200 comprises a face plate 202 having a top and a bottom edge, side edges, a front surface 203 and a back surface, and a first anchor member 210, a second anchor member 212 and a central anchor member 214 extending from the front surface 203 of the face plate 202.

In embodiments, a bracket may comprise any number of anchor members. In embodiments, a bracket comprises an even number of anchor members, such as the bracket 100 as described above. In other embodiments, a bracket comprises an odd number of anchor members, such as the bracket 200 as described above.

Referring to FIG. 1, the bracket 100 comprises the first anchor member 110 and the second anchor member 112. In embodiments, the first anchor member 110 is at an angle offset from the longitudinal centerline 106 of the face plate 102 and the second anchor member 112 is a complementary anchor member, angled at a mirrored angle offset from the centerline 106 of the face plate 102 relative to the angle of the first anchor member 110. In embodiments, a bracket may comprise any even number of anchor members, wherein each anchor member may have a complementary anchor member to form a pair of complementary anchor members. In embodiments, each pair of complementary anchor members may be at mirrored angles offset from the centerline 106. Embodiments contemplate that the magnitudes of the mirrored angles of each pair of complementary anchor members may not be exactly the same.

In embodiments with more than one anchor member and having an odd number of anchor members, each of the anchor members may have complementary anchor members as described above except one independent anchor member, which may have a transverse axis 108 that is generally in line or parallel with a longitudinal centerline. Referring to FIG. 2, in embodiments, a transverse axis 208 of the first anchor member 210 is at an angle $\alpha$ offset from the longitudinal centerline 206 of the face plate 202 and the second anchor member 212 is a complementary anchor member, a transverse axis 208 of the second anchor member 212 angled at a mirrored angle $\alpha$ offset from the centerline 206 of the face plate 202 relative to the angle of the first anchor member 210. In embodiments, the central anchor member 214 is the independent anchor member and may be centrally located between the pairs of complementary anchor members. In embodiments, a bracket may comprise any odd number of anchor members, wherein each anchor member, except for the independent anchor member, may have a complementary anchor member with each pair of complementary anchor members being at mirrored angles offset from the centerline 206. Embodiments contemplate that the magnitudes of the mirrored angles of each pair of complementary anchor members may not be exactly the same. In embodiments with one anchor member, the transverse axis of the anchor member may be at an angle offset from the longitudinal centerline axis of the face plate, or generally in line with the longitudinal centerline. In embodiments, the angle $\alpha$ is between 0 to about 60 degrees, or between about 10 to about 60 degrees. In other embodiments, the angle is between about 15 to about 45 degrees. In preferred embodiments, the angle $\alpha$ is between about 25 to about 35 degrees. In a most preferred embodiment, the angle $\alpha$ is 30 degrees.

Referring to FIGS. 1 and 2, the anchor members are located on a common side edge 104, 204 of the bracket 100, 200. This allows the bracket 100, 200 to be uniquely flipped and oriented to be inserted in positions opposing, similar, or facing another bracket 100, 200, to avoid having ICF web members affecting the layout of the brackets 100, 200, as will be described in more detail below. The uniqueness allows accurate and uncompromised installation of floor joist members without deviation to the intended floor layout. Although the term side edge is used in relation to the common side edge 104, 204, it is understood that, in embodiments, the face plate 102, 202 may not be rectangular and the common side edge 104, 204 may include irregular contours or edges of the face plate 102, 202 and may also include additional edges or sides of the bracket 100, 200.

Each anchor member is sized to extend from the surface 103, 203 of the face plate, a length greater than the thickness of an insulation panel and adequately terminating a distance within a cavity between opposing insulation panels representing a cast concrete wall.

Foam ICF wall panels are commonly between 2.5" and 4" thick. The cavity between opposing ICF wall panels is commonly 6", 8", 10" or 12" wide. In an exemplary embodiment, the foam ICF wall panels are 2.5" thick, the cavity is 6" wide and the anchor members are 8" long. In this exemplary embodiment, the anchor members extend 5.5" into the cavity. In embodiments, the ends of the anchor members distal from the face plate 102, 202 are rounded but they can have any appropriate shape or configuration.

The face plate and anchor members of the brackets disclosed herein are preferably planar, or flat, and preferably have a substantially rectangular surface area or shape, that is a length greater than a width. However, the face plate and anchor can have any appropriate shape including square, oval, round and irregular shapes. Additionally, while shown in the Figures as being flat, or planar, the anchor members may have other shapes, for example they may be curved along their longitudinal or transverse axes. In embodiments, the face plate is rectangular. Referring to FIGS. 3A to 5A, the face plate is a six-sided polygon comprising at least two square angles and at least two pairs of parallel segments. In embodiments, as will be described in more detail below, brackets are intended to be installed in a pair for each joist hanger in a manner that allows a joist hanger to be fastened to a pair of brackets using screws, bolts, rivets or the like.

Methods of Manufacturing

In embodiments, a bracket 100, 200 is formed in a single piece, from a sheet of malleable metal, such as steel. In embodiments, 14-gauge sheet metal is used, although any sheet metal having a thickness compatible with the use of the intended fastening means, such as self-tapping screws, may be used. Further, the thickness of the sheet metal determines the width and length of the anchor members and the distance that the anchor members can be spaced apart.

Figure 3B:
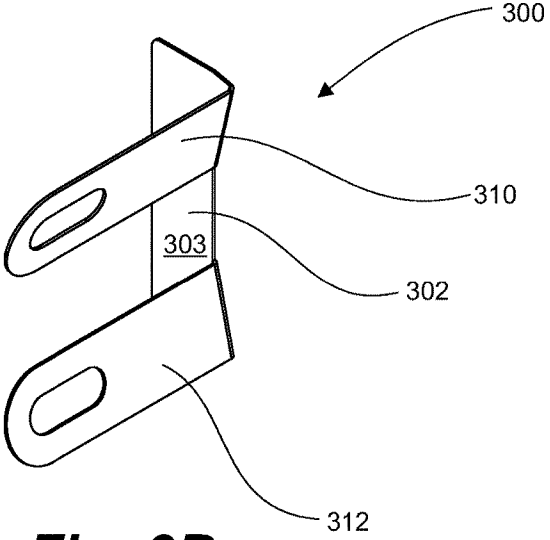
FIG. 3B is a perspective view of the bracket of FIG. 3A with the two anchor members bent to extend approximately perpendicularly from a front surface of a face plate of the bracket.
Figure 3D:
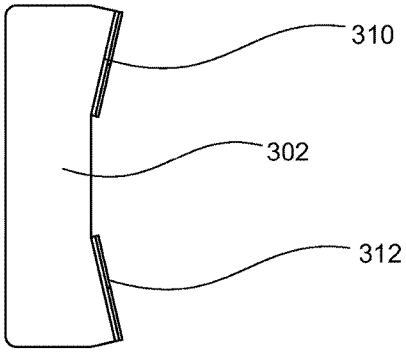
FIG. 3D is a top view of the bracket of FIG. 3B with the anchor members extending out from the page.
Figure 3A:
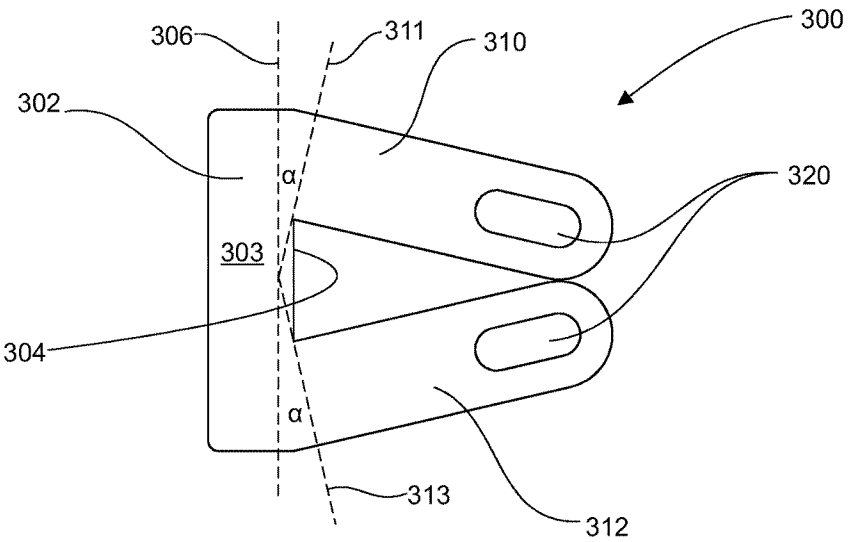
FIG. 3A is top view of an embodiment of a bracket with two unbent anchor members.
Figure 3C:
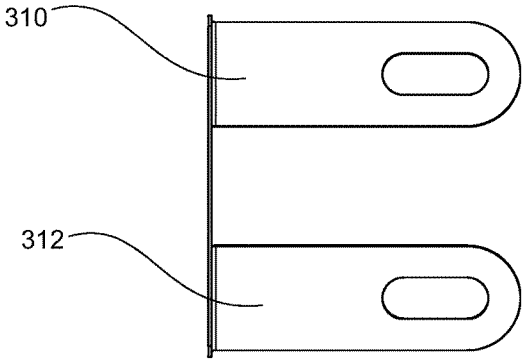
FIG. 3C is a bottom view of the bracket of FIG. 3B with the face plate extending into the page.
Figure 4B:
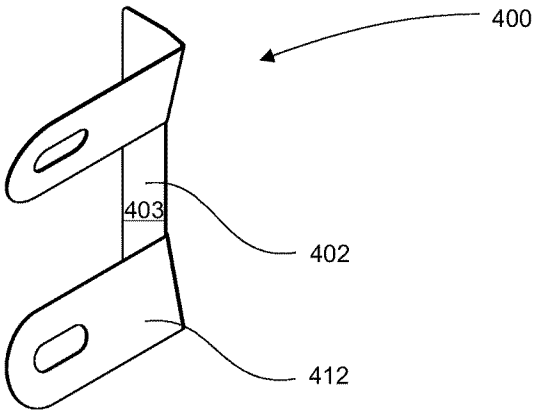
FIG. 4B is a perspective view of the bracket of FIG. 4A with the two anchor members bent to extend approximately perpendicularly from a front surface of a face plate of the bracket.
Figure 4D:
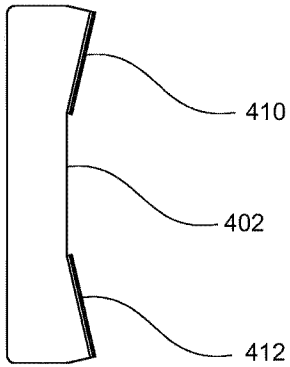
FIG. 4D is a top view of the bracket of FIG. 4B with the anchor members extending out from the page.
Figure 4A:
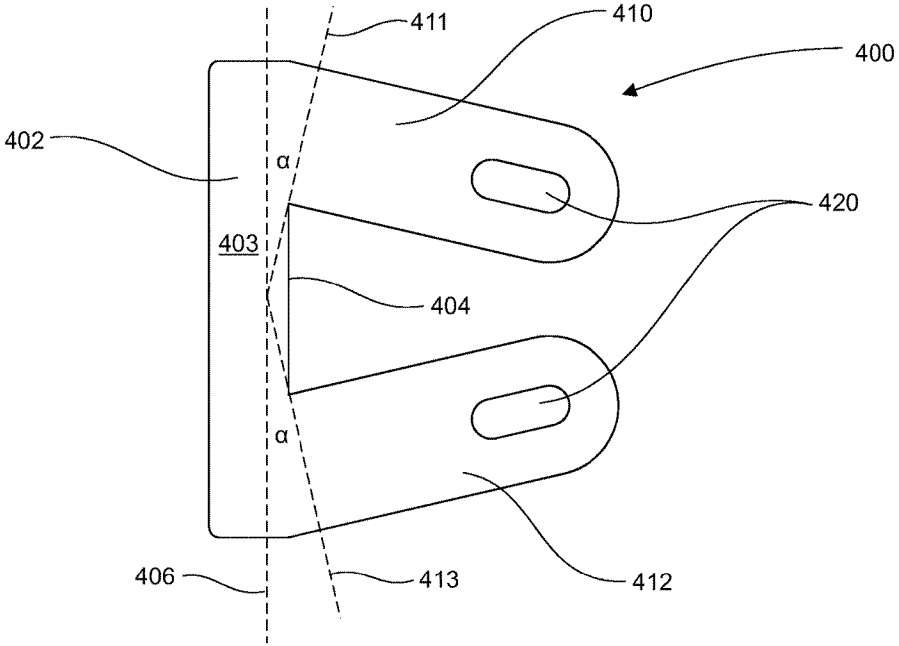
FIG. 4A is top view of an embodiment of a bracket with two unbent anchor members.
Figure 4C:
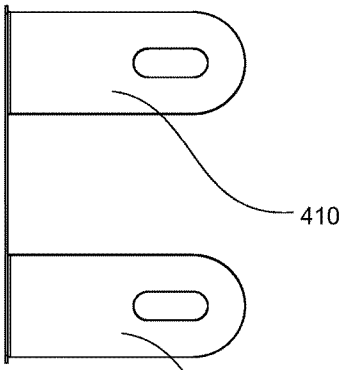
FIG. 4C is a bottom view of the bracket of FIG. 4B with the face plate extending into the page.

Referring to FIGS. 3A and 4A, in embodiments, a piece of sheet metal is provided and cut to define a patterned plate having a face plate 302, 402 and a first pair of anchor members 310, 312, 410, 412 along a common side edge 304, 404 of the face plate. Referring to FIGS. 3B to 3D and 4B to 4D, in embodiments, the first pair of anchor members 310, 312, 410, 412 are coplanar with the face plate 302, 402. Each of the anchor members is then bent, along fold lines 311, 313, 411, 413 that are offset by angle α from a longitudinal centerline 306, 406 of the plate 302, 402. The distance between the anchor members is different between 3A and 4A. The anchor members are bent so as to extend approximately perpendicularly from a front surface 303, 403, proximate the common side edge 304, 404. In embodiments, the first pair of anchor members 310, 312, 410, 412 are bent at mirroring angles α relative to the longitudinal centerline 306, 406. In embodiments, apertures 320, 420 may be formed in the first pair of anchor members 310, 312, 410, 412. In embodiments, the bracket 300, 400 may comprise an additional anchor member, or one or more additional pairs of anchor members, which may be bent at mirroring angles α relative to the longitudinal centerline 306, 406.

Figure 5A:
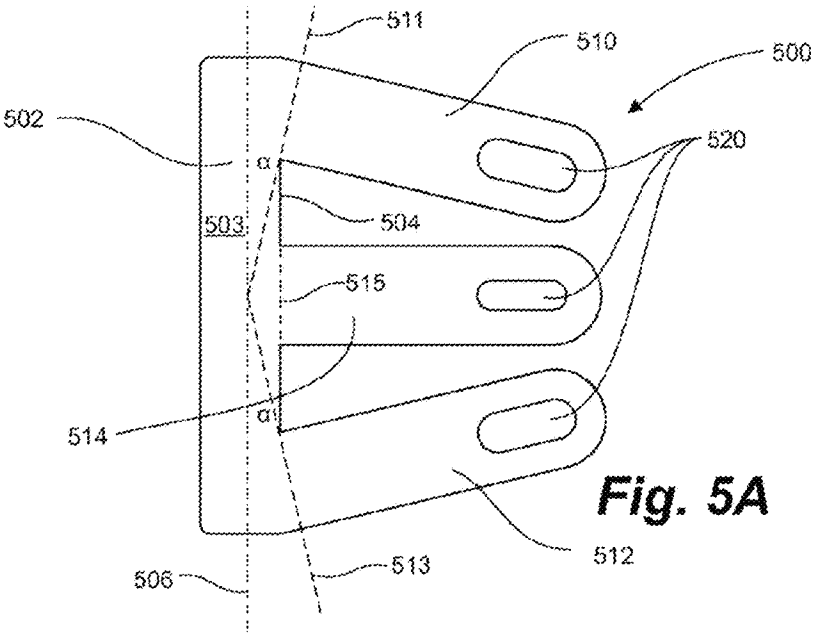
FIG. 5A is top view of an embodiment of a bracket with three unbent anchor members.
Figure 5B:
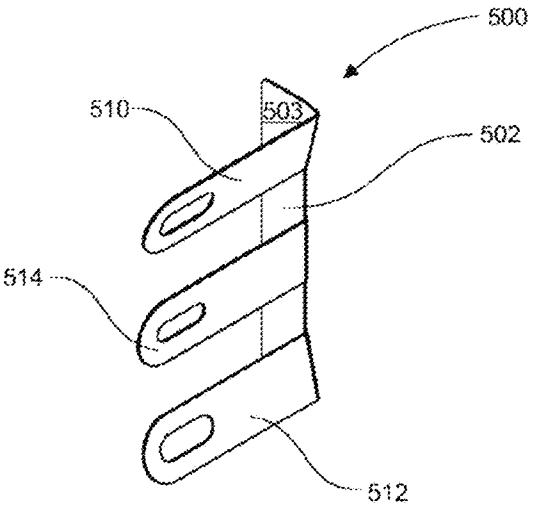
FIG. 5B is a perspective view of the bracket of FIG. 5A with the three anchor members bent approximately perpendicularly from a front surface of a face plate of the bracket.
Figure 5C:
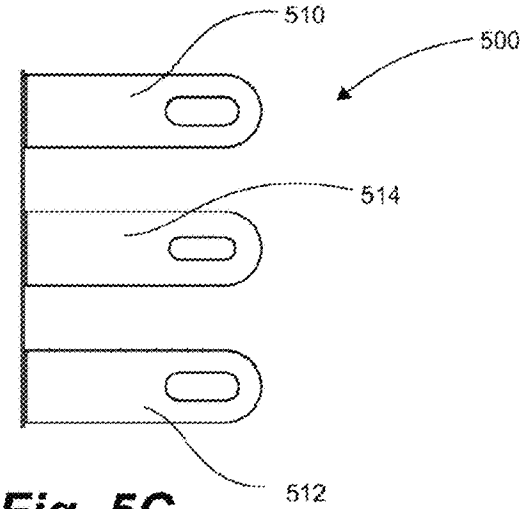
FIG. 5C is a top view of the bracket of FIG. 5B with the face plate extending into the page.
Figure 5D:
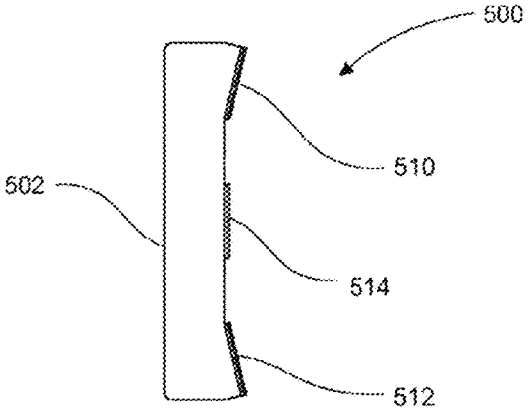
FIG. 5D is a top view of the bracket of FIG. 5B with the anchor members extending out from the page.

Referring to FIG. 5A, in embodiments, a piece of sheet metal is provided and cut to define a face plate 502 and a first pair of anchor members 510, 512 and a central anchor member 514 along a common side edge 504 of the face plate. Referring to FIGS. 5B to 5D, in embodiments, the first pair of anchor members 510, 512 and the central anchor member 514 are coplanar with the face plate 502. Each of the anchor members is then bent, along fold lines 511, 513, 515 that may be offset by angle α from a longitudinal centerline 506 of the plate 502. The anchor members are bent so as to extend approximately perpendicularly from a front surface 503, proximate the common side edge 504. In embodiments, the first pair of anchor members 510, 512 are bent at mirroring angles α relative to the longitudinal centerline 506. In embodiments, the fold line 515 of central anchor member 514 is parallel to the longitudinal centerline 506. In embodiments, apertures 520 may be formed in the first pair of anchor members 510, 512 and the central anchor member 514. In embodiments, the bracket 500 may comprise one or more additional pairs of anchor members, which may be bent at mirroring angles relative to the longitudinal centerline 506.

Figure 6A:
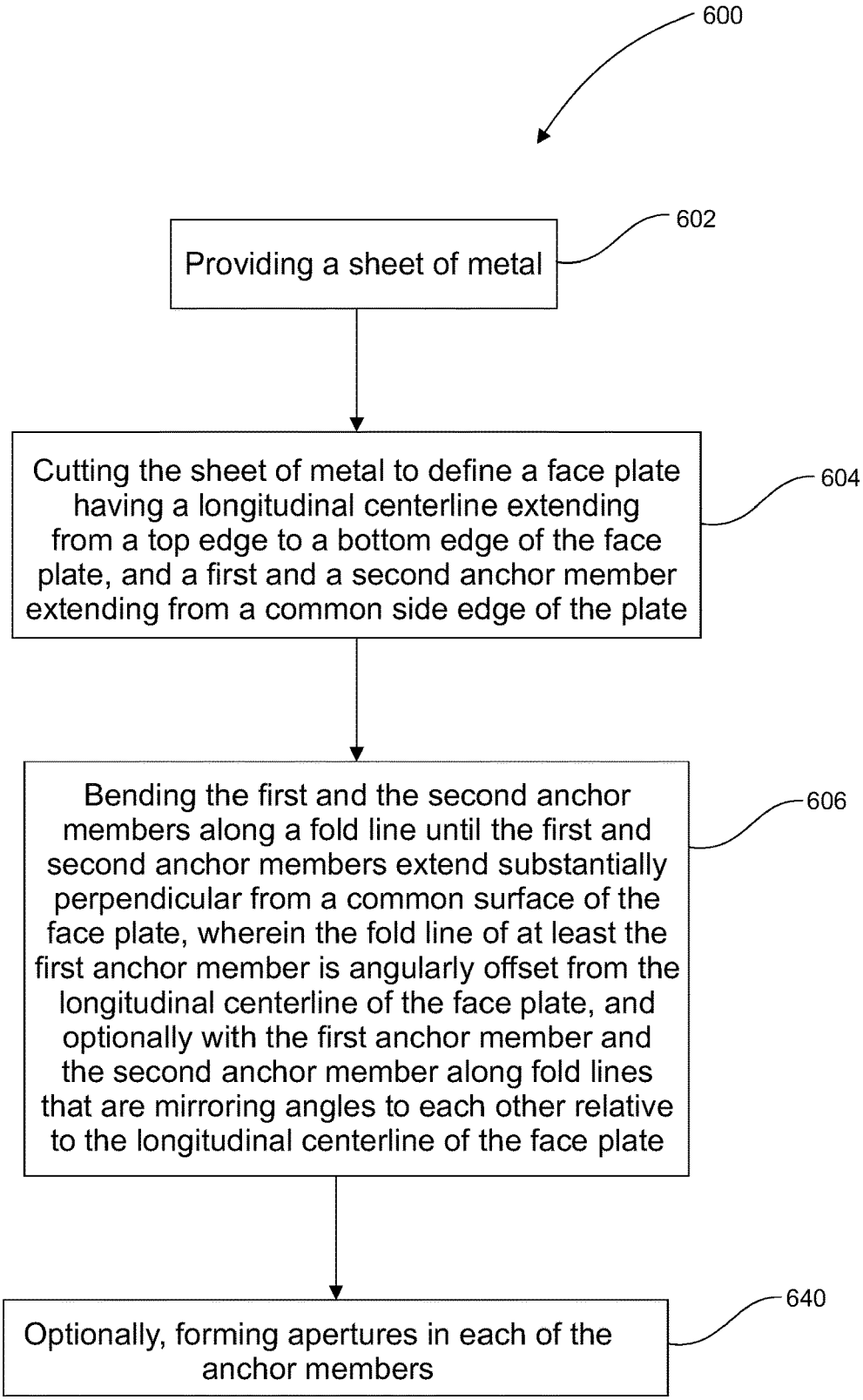
FIGS. 6A to 6C are flowcharts illustrating methods of manufacturing embodiments of a bracket.

Referring to FIG. 6A, in an embodiment, a method of manufacturing a bracket 600 comprises the steps of providing a sheet of metal 602; cutting the sheet of metal to define a face plate having a longitudinal centerline extending from a top edge to a bottom edge of the face plate and a first and a second anchor member extending from the face plate along a common side edge of the plate 604; bending the first and the second anchor members along a fold line until the first and second anchor members extend substantially perpendicularly from a common surface of the face plate, wherein the fold line of at least the first anchor member is angularly offset from the longitudinal centerline of the face plate and optionally with the first anchor member and the second anchor member along fold lines that are mirroring angles to each other relative to the longitudinal centerline of the face plate 606. "Substantially perpendicular", as used herein, means that the anchor members are bent to an angle that is about 90°, and that will permit them to be inserted into an ICF panel and into the subsequent formwork cavity, as described below.

Figure 6B:
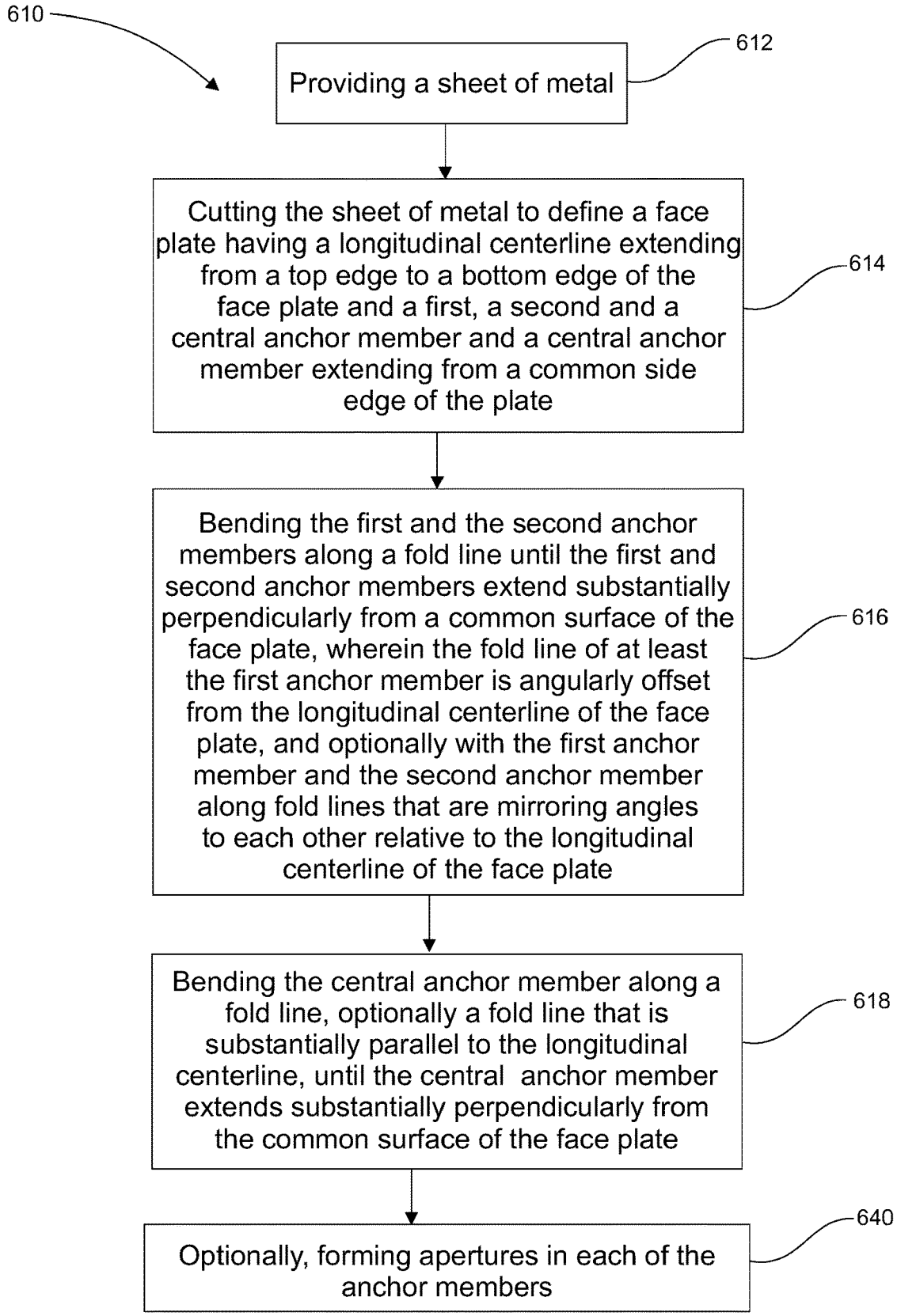

Referring to FIG. 6B, in an embodiment, a method of manufacturing a bracket 610 comprises the steps of providing a sheet of metal 612; cutting the sheet of metal to define a face plate having a longitudinal centerline extending from a top edge to a bottom edge of the face plate and a first, a second and a central anchor member extending from the face plate along a common side edge of the plate 614; bending the first and the second anchor members along a fold line until the first and second anchor members extend substantially perpendicularly from a common surface of the face plate, wherein the fold line of at least the first anchor member is angularly offset from the longitudinal centerline of the face plate and optionally with the first anchor member and the second anchor member along fold lines that are mirroring angles to each other relative to the longitudinal centerline of the face plate 616; and bending the central anchor member along a fold line, optionally a fold line that is substantially parallel to the longitudinal centerline, until the central anchor member extends substantially perpendicularly from the common surface of the face plate 618.

Figure 6C:
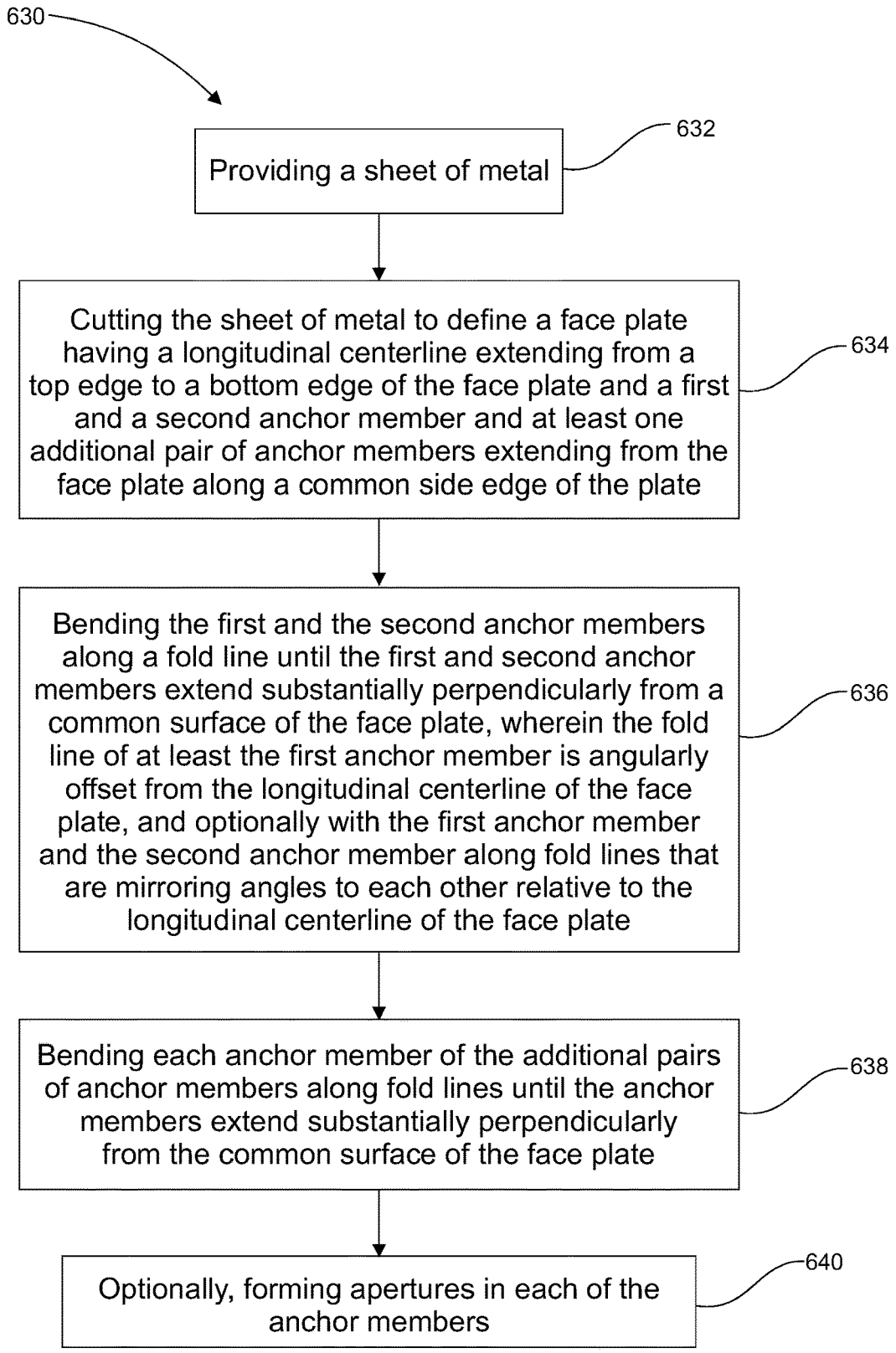

Referring to FIG. 6C, in an embodiment, a method of manufacturing a bracket 630 comprises the steps of providing a sheet of metal 632; cutting the sheet of metal to define a face plate having a longitudinal centerline extending from a top edge to a bottom edge of the face plate and a first and a second anchor member and at least one additional pair of anchor members all extending from the face plate along a common side edge of the plate 634; bending the first and the second anchor members along a fold line until the first and second anchor members extend substantially perpendicularly from a common surface of the face plate, wherein the fold line of at least the first anchor member is angularly offset from the longitudinal centerline of the face plate and optionally with the first anchor member and the second anchor member along fold lines that are mirroring angles to each other relative to the longitudinal centerline of the face plate 636; and bending each anchor member of the additional pairs of anchor members along fold lines until the anchor members extend substantially perpendicularly from the common surface of the face plate 638.

Any of the above methods may further comprise the optional step of forming apertures in each of the anchor members 640.

Method of Installation

In an embodiment, a method of installation of joists using the brackets disclosed comprises installing the brackets in the ICF forms pre-casting and installing joist hangers post-casting.

Figure 7A:
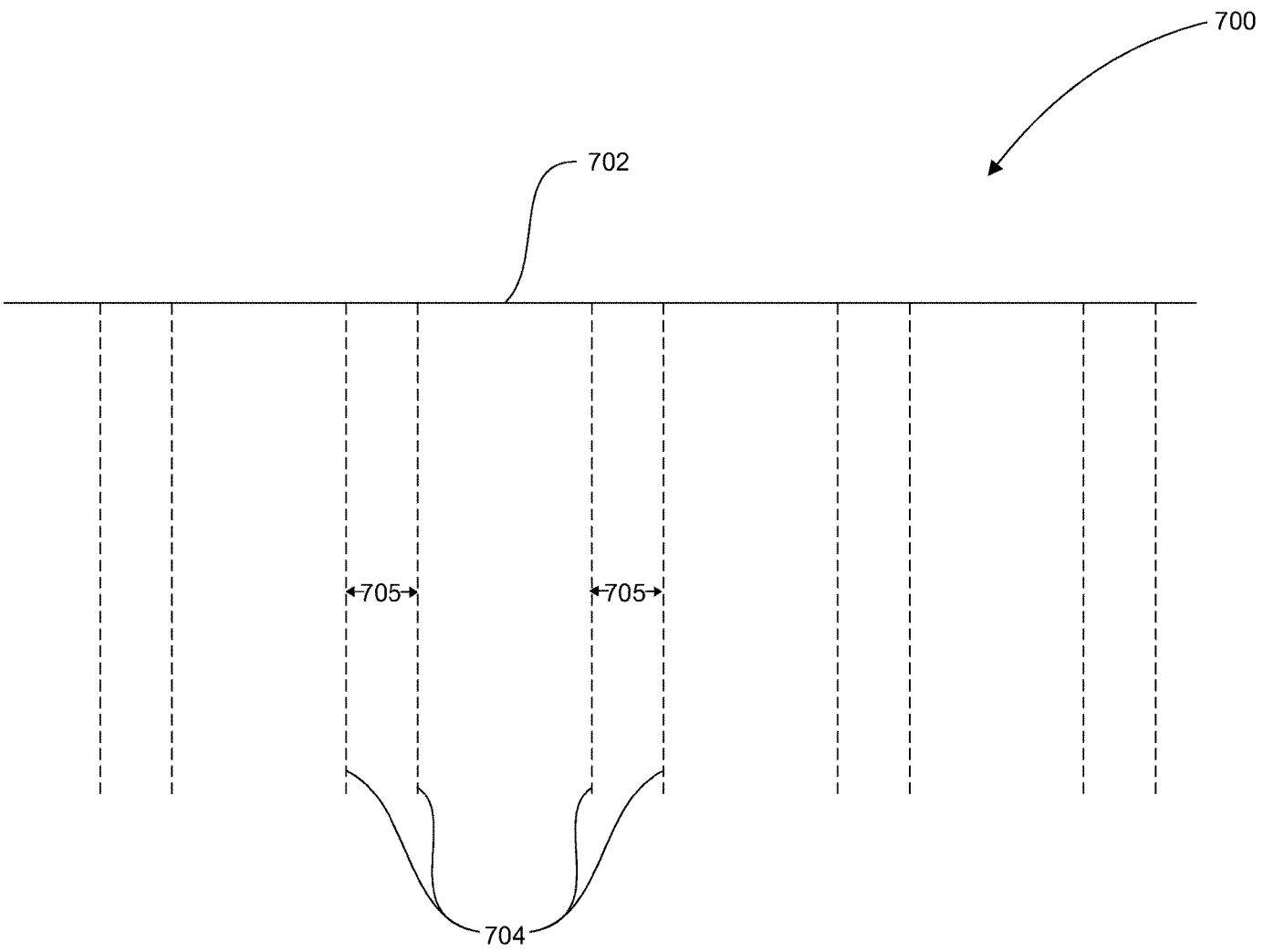
FIG. 7A is an illustration of a portion of an ICF panel showing the layout of ICF web locations and a joist snap line.
Figure 7B:
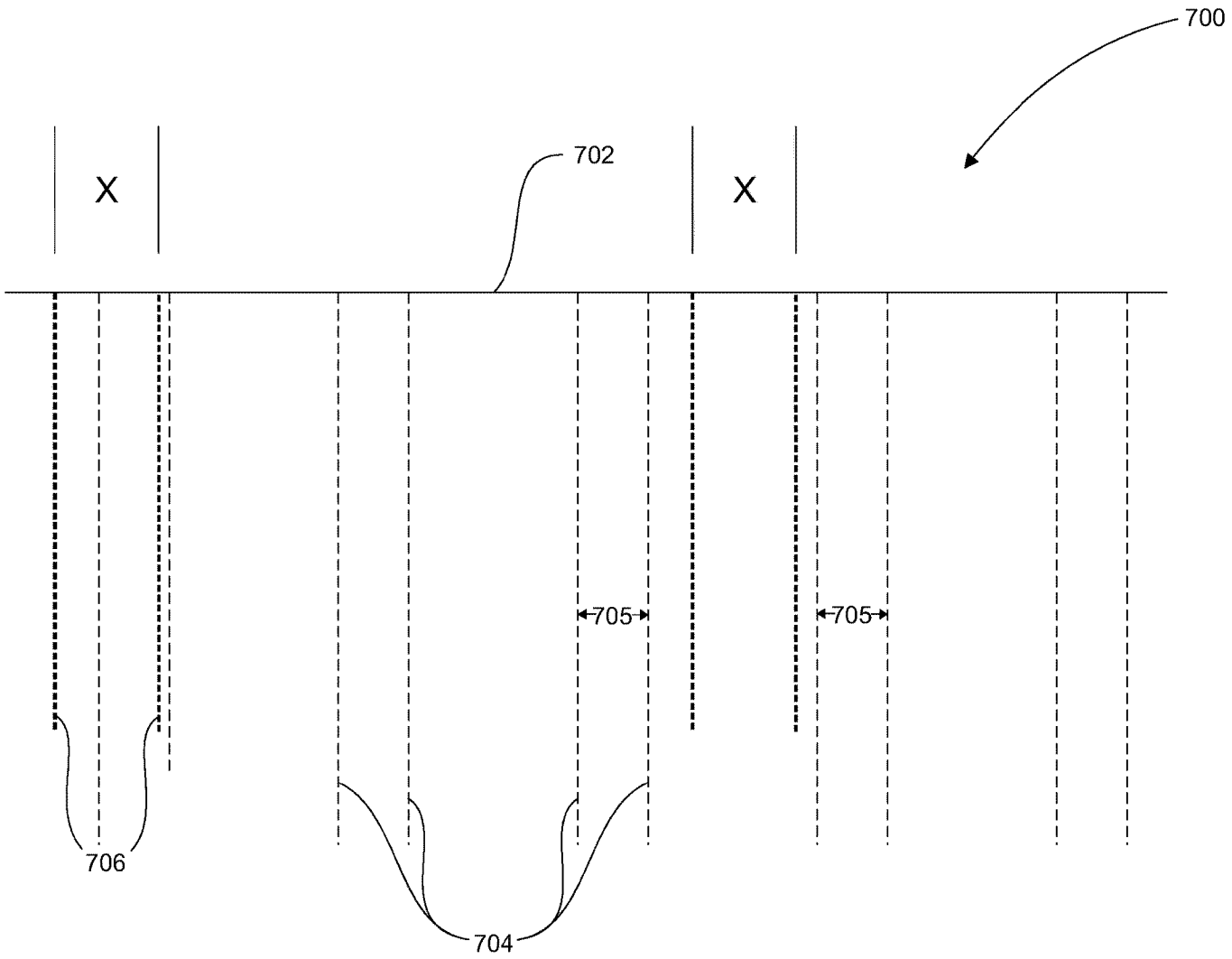
FIG. 7B is an illustration of the layout of FIG. 7A showing joist locations.

Referring to FIG. 7A, an ICF panel 701 of an ICF wall 700 is marked with ICF web lines 704 and a snap line 702 representing the tops of joists. ICF web lines 704 represent the locations of the ICF web 705, which spaces the ICF panels from one another and holds ICF panels together. Referring to FIG. 7B, widths of joists to be used are determined and joists are laid out at desired spacing and joist locations 706 are marked off. Referring to FIG. 7B, the centers of the joist locations 706 can be denoted with an "X". In embodiments, the joists are floor joists spaced apart at 16", 19.2" or 24" increments but the joists can be laid out in any appropriate dimension and configuration depending on floor design.

Figure 7C:
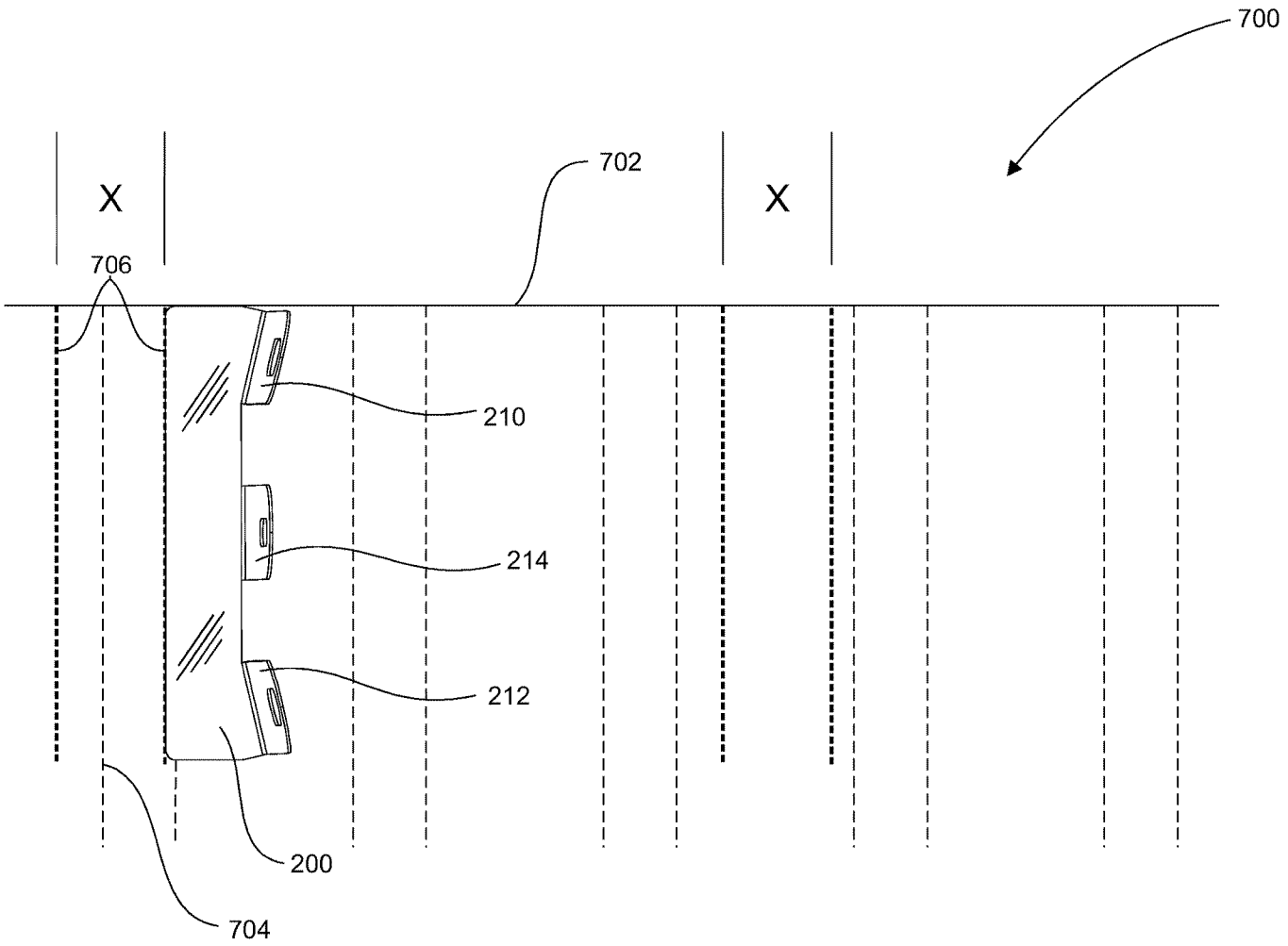
FIG. 7C is an illustration of the layout of FIG. 7B with a bracket.
Figure 7D:
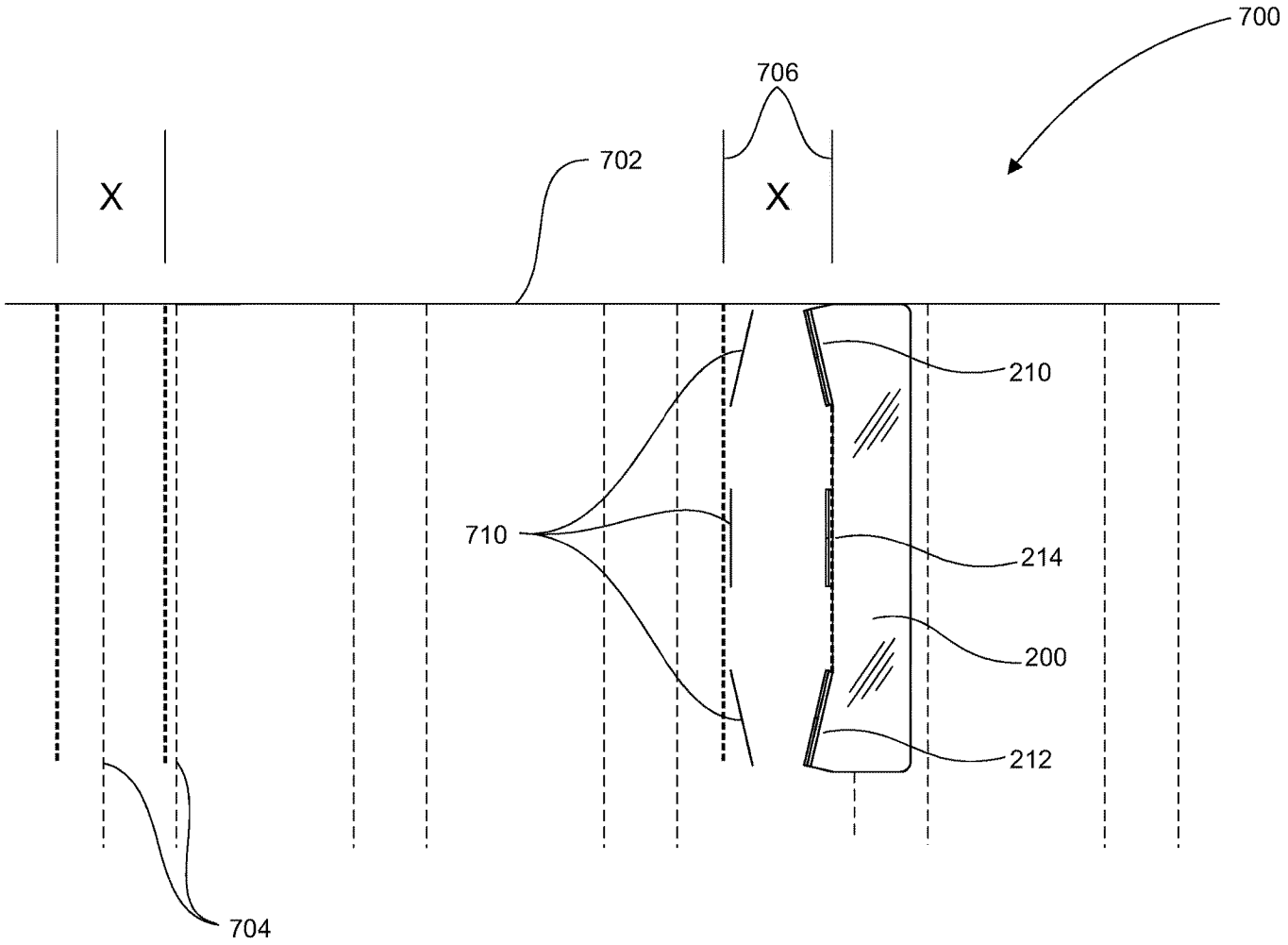
FIG. 7D is an illustration of the layout of FIG. 7B with a bracket and anchor insertion points.
Figure 7E:
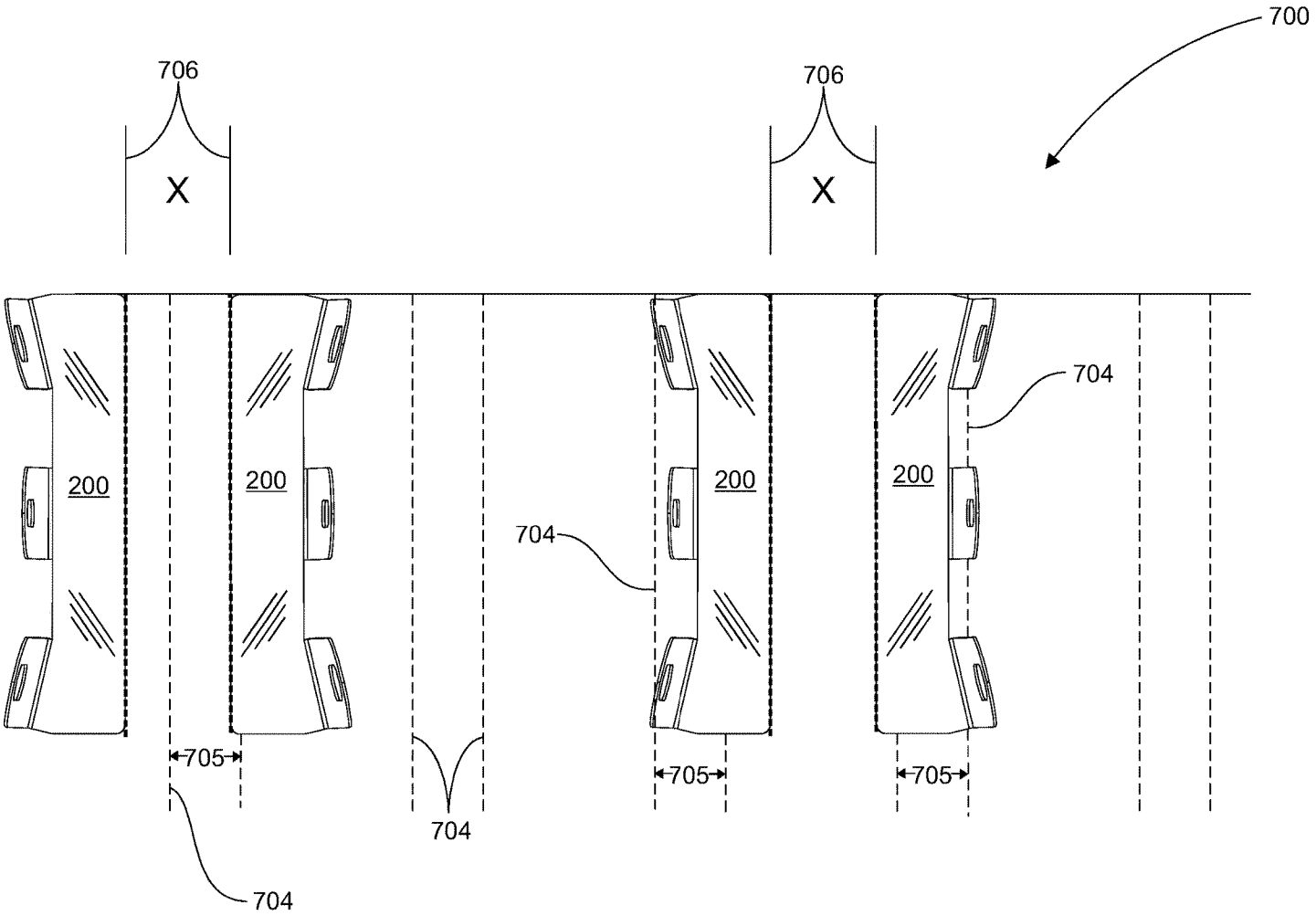
FIG. 7E is an illustration of the layout of FIG. 7B with two pairs of brackets.

Referring to FIGS. 7C and 7D, in embodiments, desired locations of anchor members 210, 212, 214 of a bracket 200 are marked off. In embodiments, the bracket 200 can be used by physically holding the bracket 200 up against the ICF foam panel 701 of the wall 700 and the locations of the anchor members 210, 212, 214 being marked off using felt, pen, chalk or other appropriate means. A top of the bracket 200 can be held up against and perpendicular to the snap line 702 in the vertical aspect. Once the bracket 200 is removed from the ICF wall 700, the locations of insertion points 710 of the anchor members 210, 212, 214 are clearly denoted on the ICF panel 701 of the wall 700. In embodiments with mirroring anchoring members 210, 212, the anchor member locations can be marked off at the face plate 202, as shown in FIG. 7E. if the anchor members 210, 212 are not mirrored, their locations are marked at the ends distal to the face plate 202, by flipping the bracket 200 over. The former is preferred for user convenience.

Figure 7F:
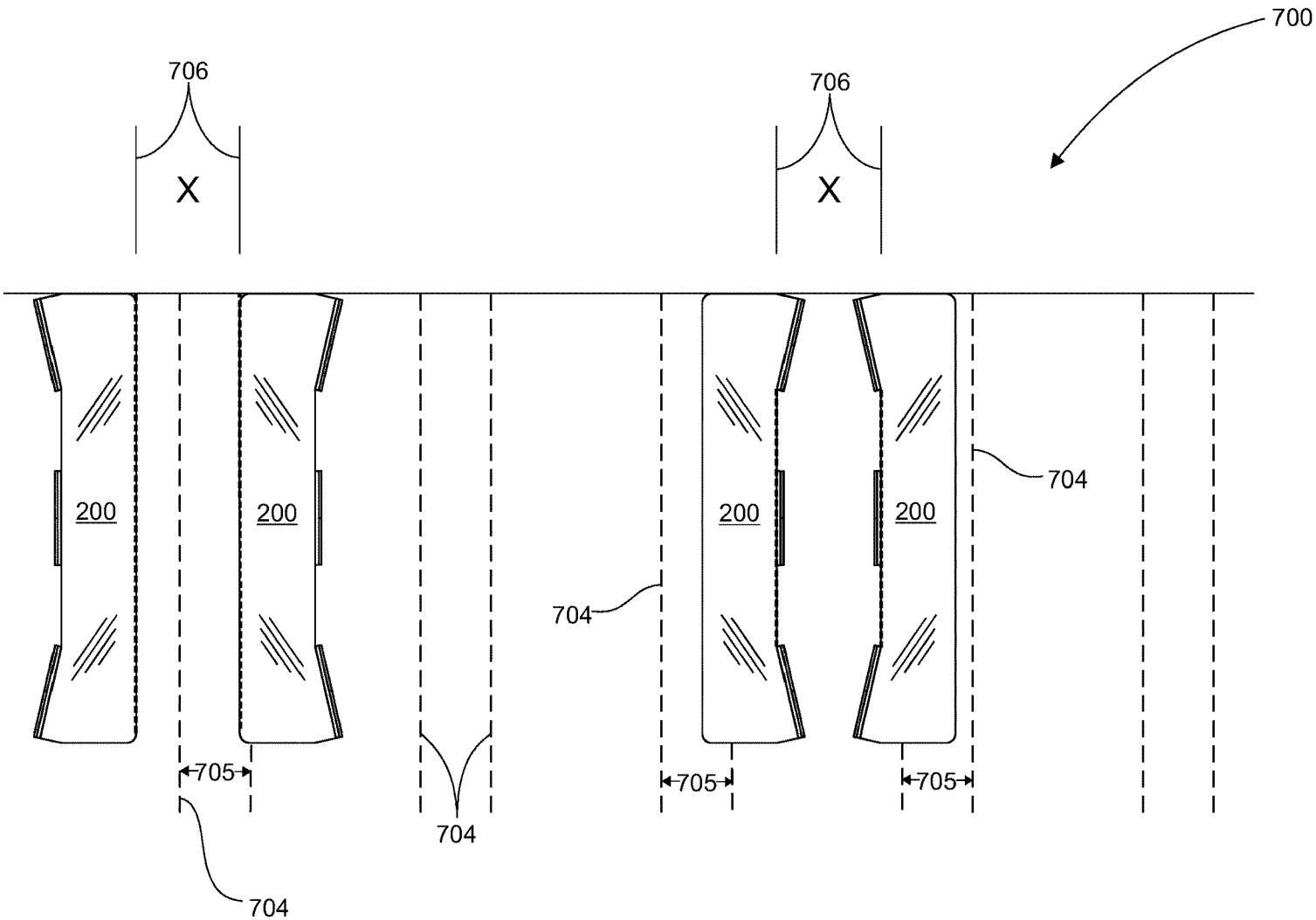
FIGS. 7Fi to 7Fiii are illustrations of the layout of FIG. 7B with three alternative layouts of a pair of brackets, as compared to FIG. 7E.

Referring to FIG. 7E, in embodiments, two pairs of brackets 200 are initially positioned and marked off in a configuration whereby each bracket 200 is in a convex orientation relative to an opposing bracket 200 (herein, a relative convex orientation). The anchor members of the pair of brackets 200 on the left completely miss any portions of the ICF web 705 while the anchor members of the pair of brackets 200 on the right are partially located on the ICF webs 705. ICF webs are commonly 1.5" wide and made of plastic. It is generally not acceptable to cut slots in the plastic ICF webs 705 for the insertion of the anchor members 210, 212, 214 of the brackets 200. In a required case, the configuration of the brackets 200 can be flipped such that each bracket 200 is in a concave orientation relative to an opposing bracket 200, that is, the brackets 200 are oriented in a relative concave orientation as illustrated for the pair of brackets 200 on the right in FIG. 7Fi. Referring to FIG. 7Fi to 7Fiii, each bracket 200 can be installed in one of two orientations, and each pair of brackets can assume one of four different configurations: with opposing anchor members (FIG. 7Fi, left), with facing anchor members (FIG. 7Fi, right), with both anchor members facing right (FIG. 7Fii, left) and with both anchor members facing left (FIG. 7Fiii, left). The brackets 200 disclosed herein can be oriented in either relative concave (FIG. 7Fi, right) or convex (FIG. 7Fi, left) or nesting (FIG. 7Fii or Fiii, right) orientation for this purpose, being to be able to accommodate the location of the ICF webs 705 without deviating from the desired locations of the joists. Any pair of brackets 200 in a system can be oriented in any manner. Further, the anchor members 210, 212, 214 can be installed between ICF webs 705, while face plates can be installed over or between ICF webs 705, in a relative concave or convex orientation or with their curvatures facing the same direction. The anchor members 210, 212, 214 with mirroring angles within each bracket 200 allow the brackets 200 to provide adequate structural support in any of the specified configurations.

Figure 7G:
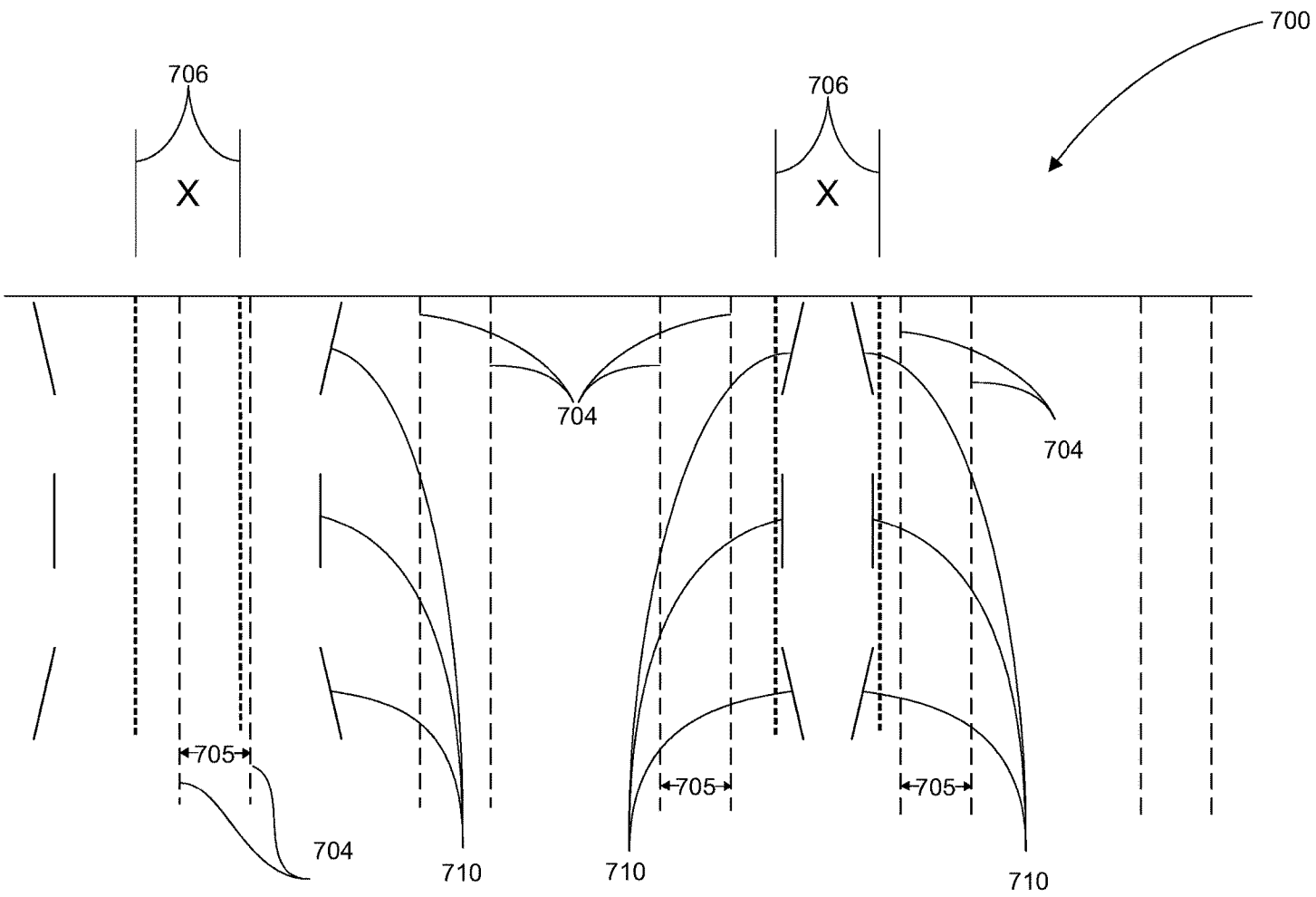
FIG. 7G is an illustration of the layout of FIG. 7Fi showing anchor insertion points.

Referring to FIG. 7G, the marked locations of the anchor insertion points 710 are illustrated. In embodiments, slots in the foam panel 701 of the ICF wall 700 can be cut with knives, saws or other appropriate means where the anchor insertion points 710 have been marked off. As is shown, the slots completely miss the ICF web.

Figure 8A:
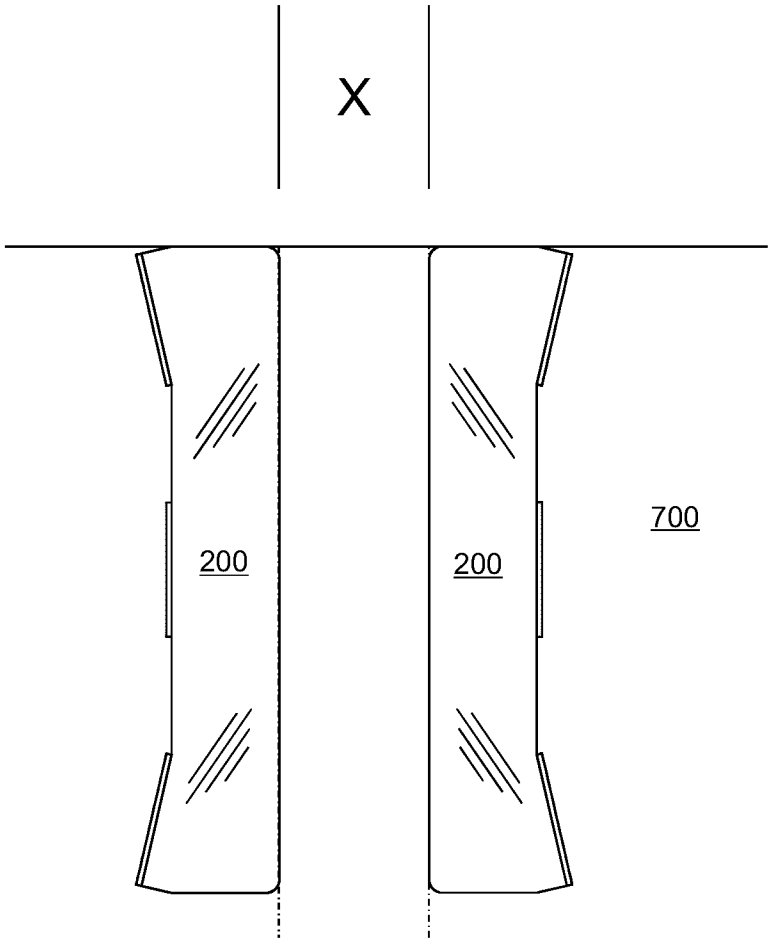
FIG. 8A is an illustration of a pair of brackets inserted into an ICF panel, which may form part of an ICF wall.
Figure 8B:
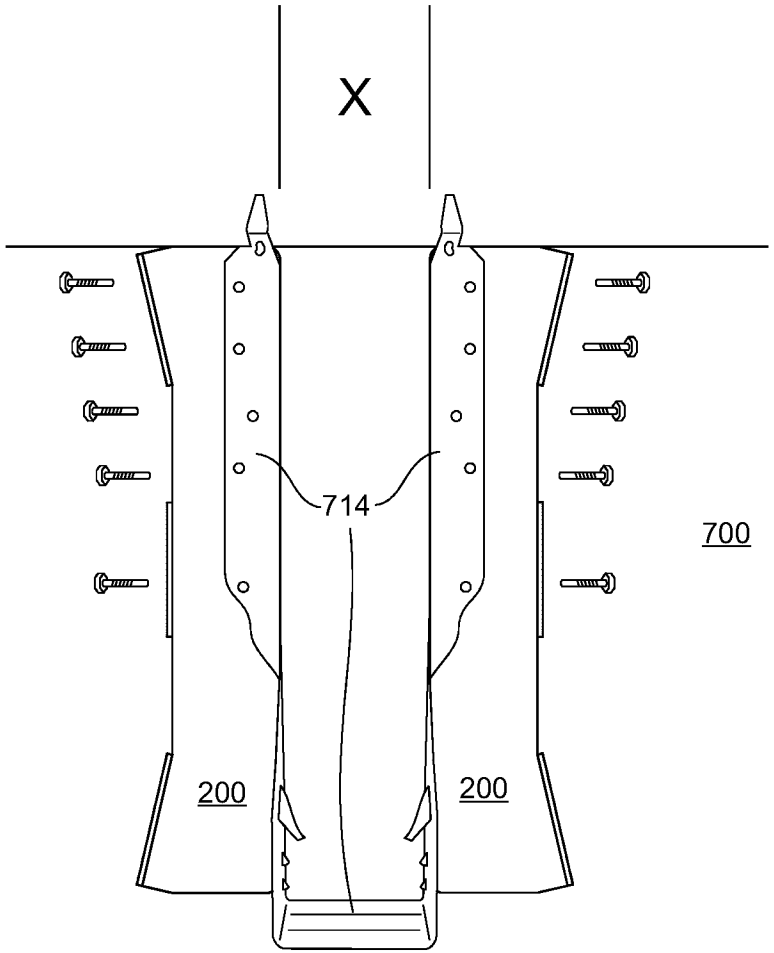
FIG. 8B is an illustration of the layout of FIG. 8A and a joist hanger.
Figure 8C:
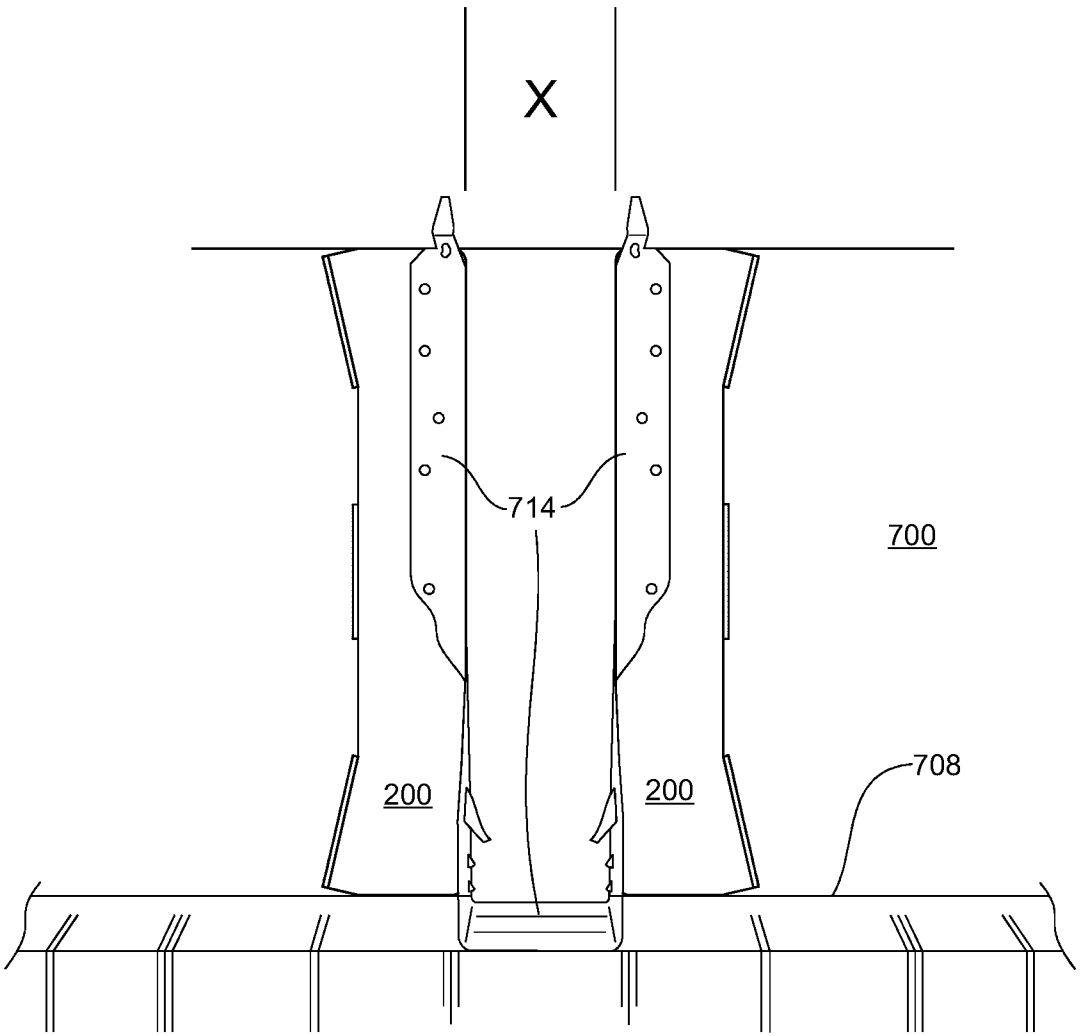
FIG. 8C is an illustration of the layout of FIG. 8A with the joist hanger attached to the pair of brackets.
Figure 10:
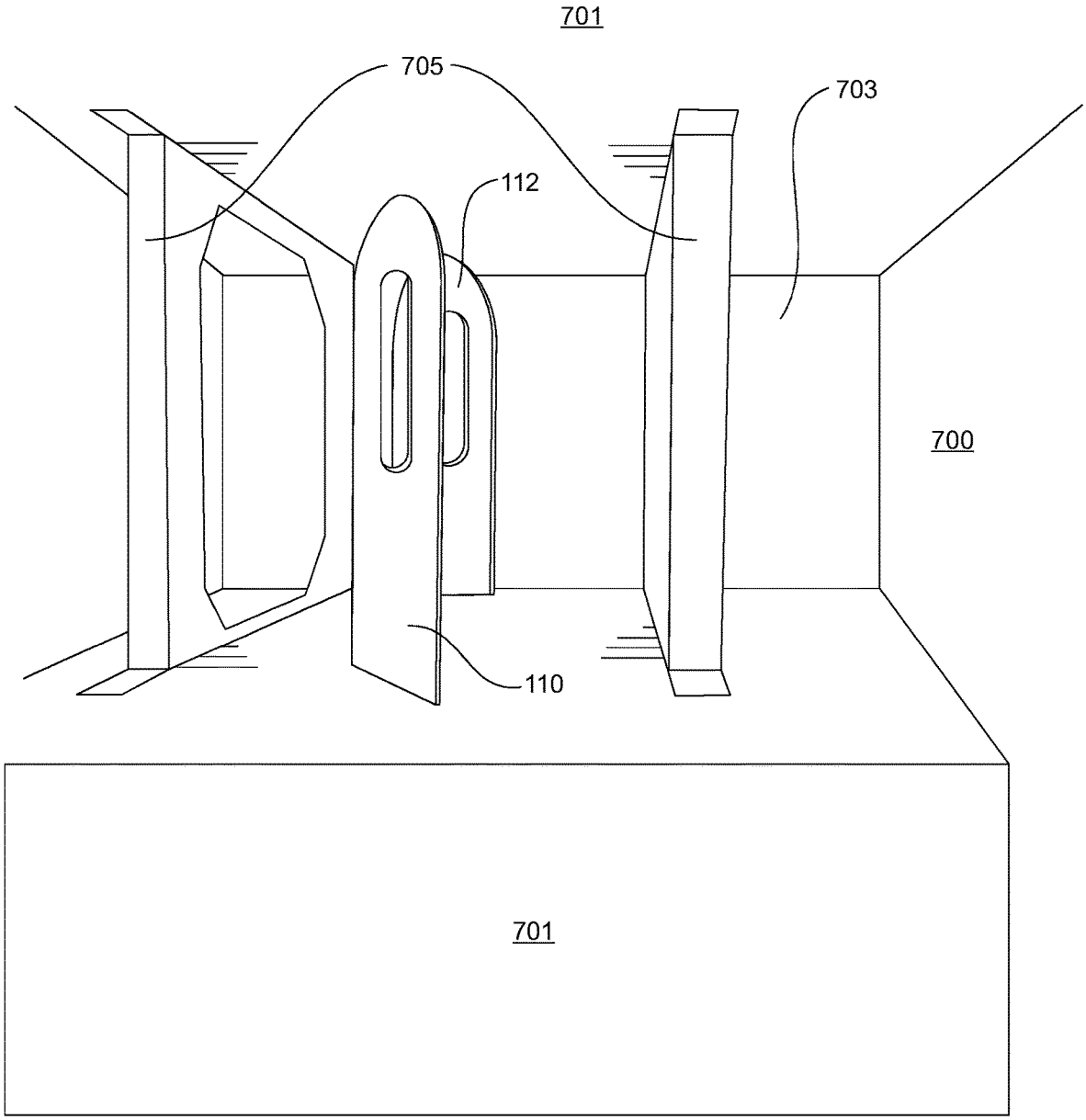
FIG. 10 is an illustration of an ICF wall 700 comprising ICF panels 701, a formwork cavity 703, ICF webs 705 and anchor members 110,112 inserted through the ICF panel and into the formwork cavity.

Referring to FIG. 10, the brackets 200 can then be placed with the anchor members 210, 212, 214 inserted, as by pushing, through the ICF panel 701 at the anchor insertion points 710. Referring to FIGS. 8A to 8C, the brackets 200 are installed with the face place of a pair of brackets 200 flush against the foam panel 701 of the ICF wall 700.

In embodiments, the inserted brackets 200 can be held in place with cleats or other reinforcing means to retain the brackets 200 in place as concrete is poured into the cavity 703 of the ICF mold. Reinforcing means may be required because ICF walls 600 can become compressed when they are loaded with concrete. Concrete is cast into the cavity 7, securing the anchor members 210, 212, 214 in place.

Installers of ICF walls 700 typically build from the inside of the structure outwards. In doing so, installers tend to compress the interior face of the ICF walls 700 more than the exterior face of the walls as they work from the inside. Bracing is commonly attached to the interior face of the ICF wall 700 placing another load therein. Furthermore, installers walking on bracing place an additional load on the interior of the ICF wall 700. As the interior joints of the ICF wall 700 are tight, the exterior joints therefore open up. As an example, load from concrete may be in the order of 5,000 pounds per cubic yard of load.

Furthermore, loads from the rebar, ICF webs 705 and friction against the connecting surfaces all direct larger forces in a downward direction on the ICF wall 600. As an example, before the concrete is poured, the interior wall can be 80% compressed and the exterior wall can be 20% compressed. Once the concrete is poured, both the interior and exterior wall become 100% compressed. Because the exterior wall is compressed relatively more than the interior wall, the concrete filled ICF wall 700 tends to lean outwards and away from the braces.

As a result of this compression, cast-in joist hangers and ledgers move as the ICF wall experiences compression. This causes the elevation of hangers to be lower than when installed pre-casting, requiring shimming or other means to adjust the locations of joists. The use of shimming in an upward direction requires shimming downwards as well.

This further necessitates the use of strapping under floor joists as without strapping, drywall will not finish properly against walls.

Referring to FIGS. 8A to 8C, in embodiments, joist hangers 714 may be mechanically fastened to the brackets 200, typically after the concrete has set. Referring to FIG. 8C, using the disclosed brackets 200, after compression, a bottom snap line for the joists 708 is established post-casting. As an example, 2"×4" lumber can be used, being set at the bottom of floor joists. A joist hanger 714 can then be set on the 2"×4" bottom snap line 708 and the joist hanger 714 can be directly attached to brackets 200. This can be done with self-tapping screws. In embodiments, self-tapping screws are #10 sheet metal screws.

The installation of joists using the disclosed brackets 200 does not require the use of a ledger from which to attach joist hangers as joist hangers 714 are connected to brackets 200. The elevation of each joist hanger 714 can therefore be selected to avoid the need for shimming, which typically results from ICF wall 700 settlement or compression. In practice, this also provides complete access to the ICF wall 700 cavity 703 as a ledger does not get in the way of any other sub trade chases such as electrical runs, plumbing pipes, ducting, etc. from floor to floor.

Figure 9A:
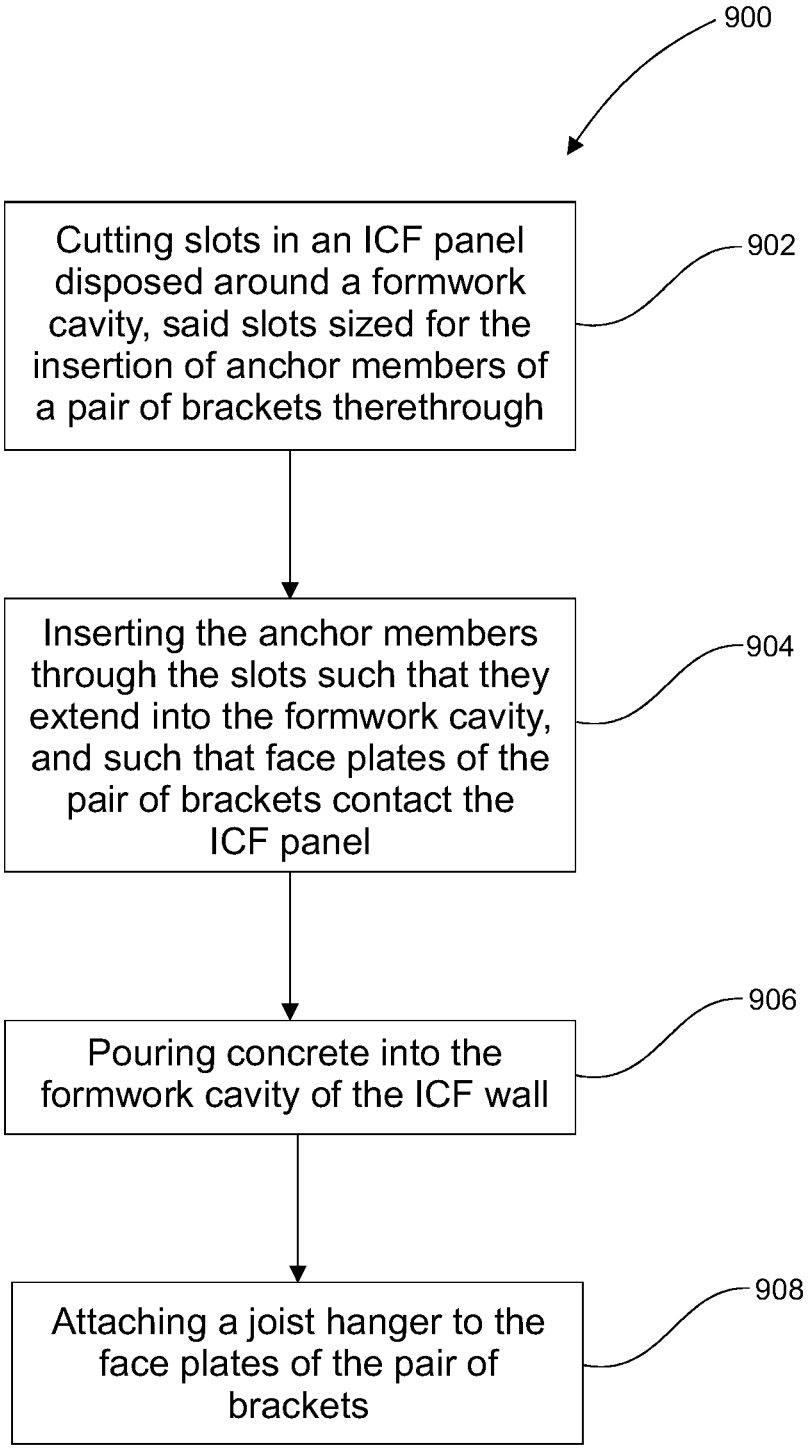
FIGS. 9A to 9C are flowcharts illustrating methods of installation of joist hangers using brackets.

Referring to FIG. 9A, in an embodiment, a method of installing joist hangers on an ICF wall 900 comprises the steps of cutting slots in an ICF panel disposed around a formwork cavity, said slots sized for the insertion of anchor members of a pair of brackets therethrough 902; inserting the anchor members through the slots such that they extend into the formwork cavity, and such that face plates of the pair of brackets contact the ICF panel 904; pouring concrete into the formwork cavity of the ICF wall 906; and attaching a joist hanger to the face plates of the pair of brackets 908.

Figure 9B:
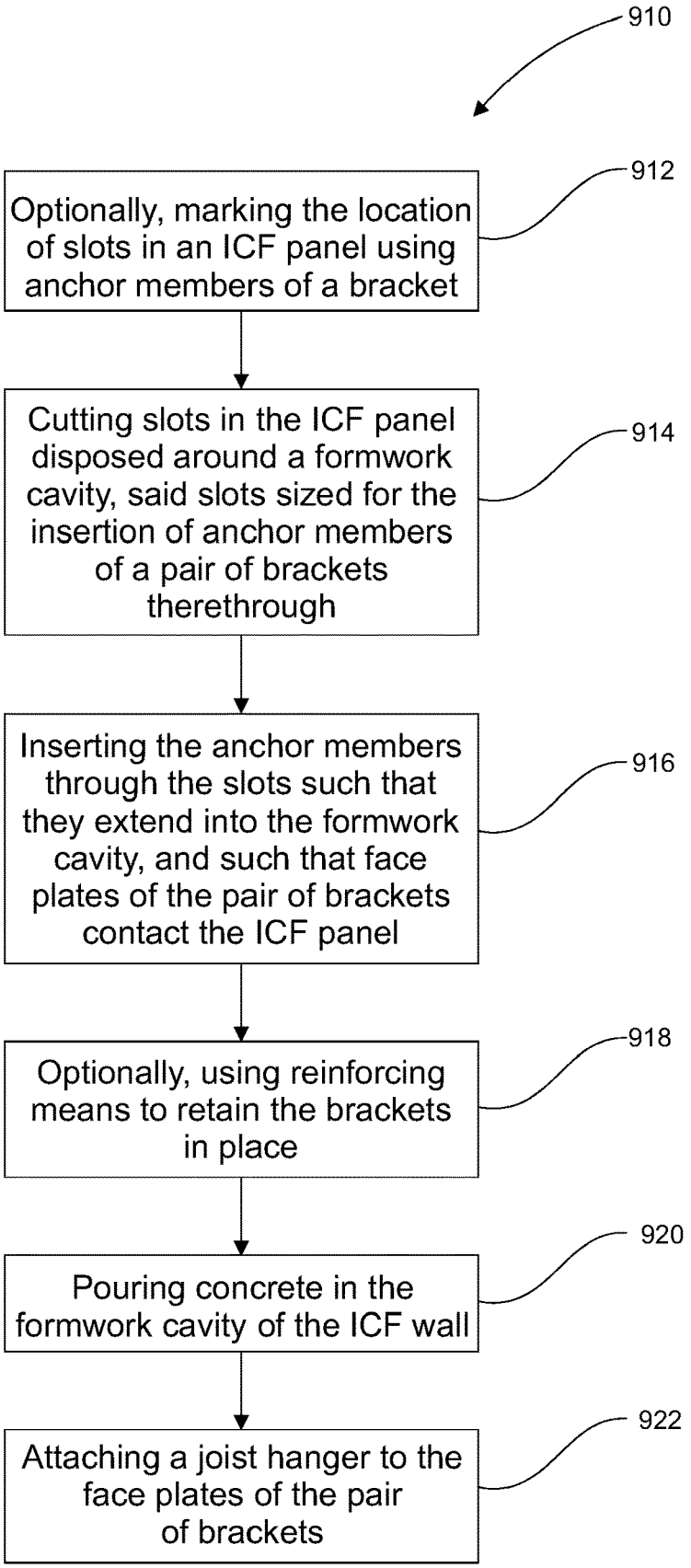

Referring to FIG. 9B, in an embodiment, a method of installing joist hangers on an ICF wall 910 comprises the steps of optionally, marking the location of slots in an ICF panel using anchor members of a bracket 912; cutting slots in the ICF panel disposed around a formwork cavity, said slots sized for the insertion of anchor members of a pair of brackets therethrough 914; inserting the anchor members through the slots such that they extend into the formwork cavity, and such that face plates of the pair of brackets contact the ICF panel 916; optionally, using reinforcing means to retain the brackets in place 918; pouring concrete into the formwork cavity of the ICF wall 920; and attaching a joist hanger to the face plates of the pair of brackets 922.

Figure 9C:
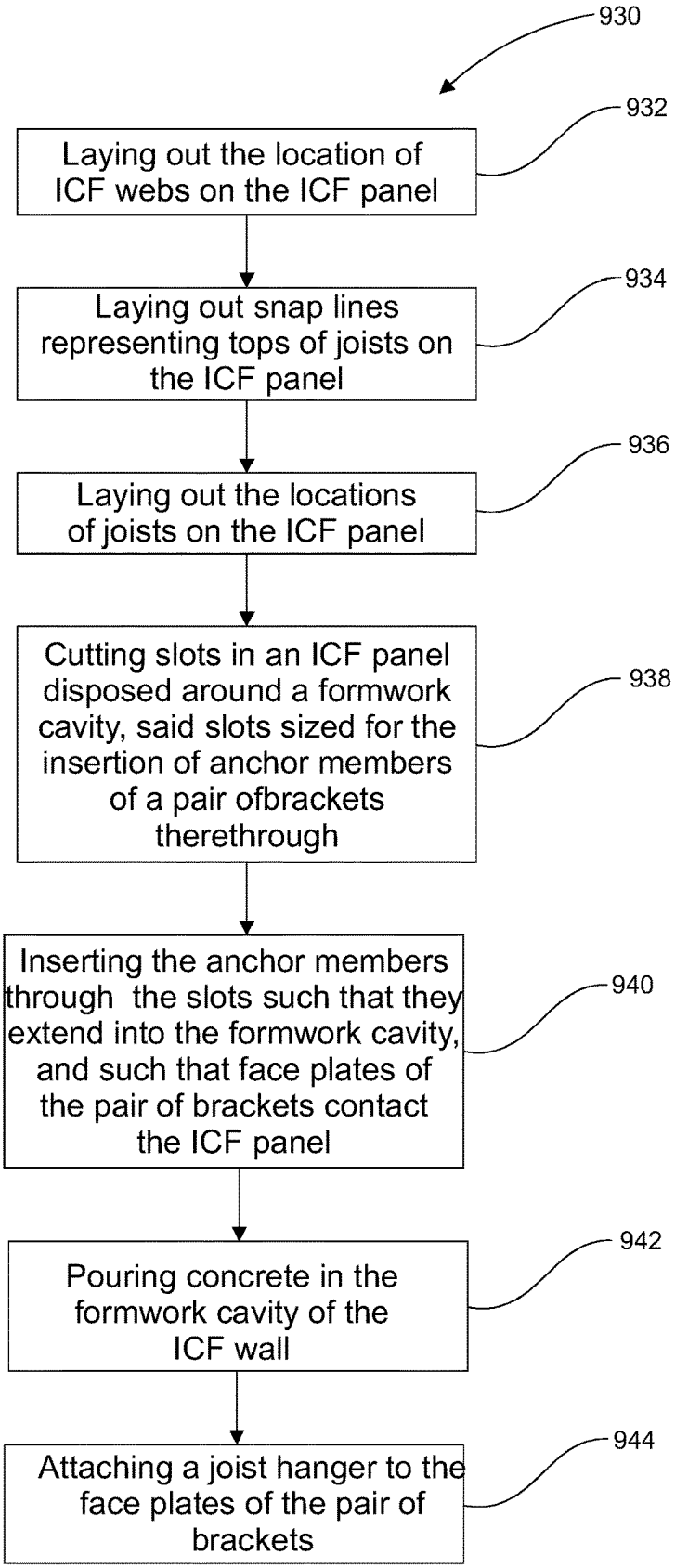

Referring to FIG. 9C, in an embodiment, a method of installing joist hangers on an ICF wall 930 comprises the steps of laying out the location of ICF webs on an ICF panel of the wall 932; laying out snap lines representing tops of joists on the ICF panel 934; laying out the locations of joists on the ICF panel 936; cutting slots in the ICF panel disposed around a formwork cavity of the wall, said slots sized for the insertion of anchor members of a pair of brackets therethrough 938; inserting the anchor members through the slots such that they extend into the formwork cavity, and such that face plates of the pair of brackets contact the ICF panel 940; pouring concrete into the formwork cavity of the ICF wall 942; and attaching a joist hanger to the face plates of the pair of brackets 944.

Although a few embodiments have been shown and described, it will be appreciated by those skilled in the art that various changes and modifications can be made to these embodiments without changing or departing from their scope, intent or functionality. The terms and expressions have been used herein as terms of description and not of limitation, and there is no intention in the use of such terms and expressions of excluding equivalents of the features shown and described or portions thereof.

The embodiments in which an exclusive property or privilege is claimed are defined as follows:

1. A bracket for attaching joist hangers to an insulated concrete form (ICF) wall comprising:

a face plate having a top and a bottom edge, side edges, and a front and a back surface, the face plate having a longitudinal centerline extending from the top edge to the bottom edge;

a first anchor member and a second anchor member extending from a common side edge of the face plate substantially perpendicular to the front surface of the face plate;

a central anchor member extending from the common side edge of the face plate substantially perpendicular to the front surface of the face plate, the central anchor member between the first anchor member and the second anchor member;

wherein:

the first anchor member, the central anchor member, and the second anchor member are for insertion through an ICF panel of the ICF wall and into a formwork cavity of the ICF wall, the first anchor member, the central anchor member, and the second anchor member each have a respective longitudinal axis extending from the face plate to a tip of each respective anchor member, and a respective transverse axis perpendicular thereto, the transverse axis of the first anchor member is offset by a first angle from an axis of the longitudinal centerline of the face plate, the transverse axis of the second anchor member is at a second angle relative to the axis of the longitudinal centerline of the face plate, and the transverse axis of the central anchor member is parallel to the axis of the longitudinal centerline of the faceplate.

2. The bracket of claim 1, wherein the first angle is between about 10 to about 60 degrees.

3. The bracket of claim 1, wherein the second angle is between about 0 to about 60 degrees.

4. The bracket of claim 1, wherein the first angle and the second angle are of the same magnitude.

5. The bracket of claim 4, wherein the first angle and the second angle mirror one another.

6. The bracket of claim 1, wherein each of the first and second anchor members further defines an aperture.

7. A method of manufacturing a bracket for attaching joist hangers to an ICF wall comprising providing a sheet of metal;

cutting the sheet of metal to define a face plate having a longitudinal centerline extending from a top edge to a bottom edge of the face plate and a first anchor member, a central anchor member, and second anchor member, the first, central, and second anchor members extending from the face plate along a common side edge of the face plate and the central anchor member between the first anchor member and the second anchor member; and bending each of the first anchor member, the central anchor member, and the second anchor member along a respective fold line until the first, central, and second anchor members extend substantially perpendicularly from a common surface of the face plate, wherein the fold line of the first anchor member is angularly offset from the longitudinal centerline of the face plate, and wherein the fold line of the central anchor member is parallel to the longitudinal centerline of the face plate, and wherein the first, central, and second anchor members are for insertion through an ICF panel of the ICF wall and into a formwork cavity of the ICF wall.

8. A method of installing joist hangers on an ICF wall comprising:

cutting slots in an ICF panel disposed around a formwork cavity, said slots sized for the insertion of anchor members of a pair of brackets therethrough, wherein at least one of the slots is cut at an angle that is offset from a vertical axis that is perpendicular to a ground level;

inserting the anchor members through the slots such that they extend into the formwork cavity, and such that face plates of the pair of brackets contact the ICF panel;

pouring concrete into the formwork cavity of the ICF wall; and attaching a joist hanger to the face plates of the pair of brackets.

9. The method of claim 8 further comprising the step of marking the location of the slots in the ICF panel using the anchor members of the bracket.

10. The method of claim 8 further comprising the step of using reinforcing means to retain the brackets in place during the step of pouring concrete into the formwork cavity.

11. The method of claim 8 further comprising the steps of:

laying out ICF webs on the ICF panel;

laying out snap lines representing tops of joists on the ICF panel; and laying out the locations of joists on the ICF panel.

12. An insulated concrete form (ICF) system comprising:

an ICF wall comprising two ICF panels and a formwork cavity therebetween; and two brackets inserted through one of the two ICF panels of the ICF wall and into the formwork cavity of the ICF wall, the two brackets spaced apart at a distance from one another for attachment of a joist hanger to the two brackets, each of the two brackets comprising:

a face plate having a top and a bottom edge, side edges, and a front and a back surface, the face plate having a longitudinal centerline extending from the top edge to the bottom edge, and a first anchor member and a second anchor member extending from a common side edge of the face plate substantially perpendicular to the front surface of the face plate, wherein:

the first anchor member and the second anchor member are for insertion through one of the two ICF panels of the ICF wall and into the formwork cavity of the ICF wall, the first anchor member and the second anchor member each have a respective longitudinal axis extending from the face plate to a tip of each respective anchor member, and a respective transverse axis perpendicular thereto, the transverse axis of the first anchor member is offset by a first angle from an axis of the longitudinal centerline of the face plate, and the transverse axis of the second anchor member is at a second angle relative to the axis of the longitudinal centerline of the face plate.

13. The ICF system of claim 12, wherein the first angle is between about 10 to about 60 degrees.

14. The ICF system of claim 12, wherein the second angle is between about 0 to about 60 degrees.

15. The ICF system of claim 12, wherein the first angle and the second angle are of the same magnitude.

16. The ICF system of claim 15, wherein the first angle and the second angle mirror one another.

17. The ICF system of claim 12, wherein each of the two brackets further comprises a central anchor member extending from the common side edge of the face plate substantially perpendicular to the front surface of the face plate, the central anchor member between the first anchor member and the second anchor member, the central anchor member for insertion through one of the two ICF panels and into the formwork cavity.

18. The ICF system of 17, wherein the central anchor member has a longitudinal axis extending from the face plate to a tip of the central anchor member, and a transverse axis perpendicular thereto, said transverse axis being parallel to the axis of the longitudinal centerline of the faceplate.

19. The ICF system of claim 12, wherein each of the two brackets further comprises one or more additional anchor members extending from the common side edge of the face plate substantially perpendicular to the front surface of the face plate, the one or more additional anchor members for insertion through one of the two ICF panels and into the formwork cavity.

20. The ICF system of claim 12, wherein each of the first and second anchor members further defines an aperture.

* * * * *